US009507322B2

(12) United States Patent
Hashi

(10) Patent No.: US 9,507,322 B2
(45) Date of Patent: Nov. 29, 2016

(54) ATOMIC CELL MANUFACTURING METHOD, ATOMIC CELL, QUANTUM INTERFERENCE DEVICE, ATOMIC OSCILLATOR, ELECTRONIC DEVICE, AND MOVING OBJECT

(71) Applicant: Seiko Epson Corporation, Tokyo (JP)

(72) Inventor: Yukihiro Hashi, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/920,103

(22) Filed: Oct. 22, 2015

(65) Prior Publication Data

US 2016/0126965 A1 May 5, 2016

(30) Foreign Application Priority Data

Oct. 29, 2014 (JP) ..... 2014-220513

(51) Int. Cl.
*G04F 5/14* (2006.01)

(52) U.S. Cl.
CPC ..... *G04F 5/145* (2013.01)

(58) Field of Classification Search
CPC ..... H03L 7/26; H01S 1/06; G04F 5/14
USPC ..... 331/3, 94.1
See application file for complete search history.

(56) References Cited

U.S. PATENT DOCUMENTS 8,258,884 B2 * 9/2012 Borwick, III ..... G04F 5/145 331/3
8,970,309 B2 3/2015 Sato et al.
2015/0372686 A1 * 12/2015 Parsa ..... G04F 5/14 250/222.1

FOREIGN PATENT DOCUMENTS

JP 06-152407 A 5/1994
JP 07-122795 A 5/1995
JP 2013-038382 A 2/2013
JP 2013-150334 A 8/2013
WO WO-2006-017345 A2 2/2006

* cited by examiner

*Primary Examiner* — Jeffrey Shin
(74) *Attorney, Agent, or Firm* — Harness, Dickey & Pierce, P.L.C.

(57) ABSTRACT

An atomic cell manufacturing method includes a preparing process of preparing a structure that includes a wall portion which forms an inner space and a portion thereof is a light transmission portion, and in which liquid or solid alkaline metals are disposed in the light transmission portion, and an adjusting process of adjusting distribution such that alkaline metals are distributed so as to be intensively disposed on an outer circumferential portion side of the light transmission portion compared to a center portion of the light transmission portion, by heating the light transmission portion.

16 Claims, 16 Drawing Sheets

ATOMIC CELL MANUFACTURING METHOD, ATOMIC CELL, QUANTUM INTERFERENCE DEVICE, ATOMIC OSCILLATOR, ELECTRONIC DEVICE, AND MOVING OBJECT

CROSS REFERENCE

This application claim benefit of Japanese Application No. 2014-220513, filed on Oct. 29, 2014. The disclosure of the prior application is hereby incorporated by reference herein in its entirety.

BACKGROUND

1. Technical Field

The present invention relates to an atomic cell manufacturing method, an atomic cell, a quantum interference device, an atomic oscillator, an electronic device, and a moving object.

2. Related Art

As an oscillator having a highly accurate oscillation characteristic over a long term, an atomic oscillator that oscillates based on energy transfer of atoms of an alkaline metal such as rubidium or cesium is known.

Generally, an operation principle of the atomic oscillator is divided into a method using a double resonance phenomenon using light and microwaves, and a method using coherent population trapping (CPT) using two types of lights having different wavelengths. Any type of atomic oscillator includes an atomic cell (a gas cell) in which an alkaline metal is sealed (for example, see JP-A-2013-38382).

In order to realize miniaturization in accordance with a recent demand for miniaturization of an atomic oscillator (particularly, a CPT-type atomic oscillator), an atomic cell having a structure in which a plurality of substrates are laminated is known. For example, in JP-A-2013-38382, when manufacturing such an atomic cell, two materials, which are obtained by bonding a glass substrate to one surface of a substrate on which a through hole passing through in the thickness direction is formed, are prepared, alkaline metals are disposed on the surface of the through hole of the glass substrate of one of the materials, and then the two materials are bonded to each other so as to seal the alkaline metal, thereby forming an inner space.

Here, typically, in the atomic cell, a large amount of the alkaline metals are sealed since a decrease in the amount of the alkaline metal over time is expected, and the surplus alkaline metals exist as liquid or solid materials.

However, in the atomic cell disclosed in JP-A-2013-38382, a large amount of the surplus alkaline metals exist on an area of the glass substrate through which light being applied to the alkaline metal transmits, and thus an amount of light transmission is reduced, and the characteristics of the light is deteriorated due to a portion of the light acting on the liquid or solid alkaline metal. For example, in the CPT-type atomic oscillator, an EIT signal which is a rapid signal generated in accordance with an electromagnetically induced transparency (EIT) phenomenon is used as a reference signal, but in the atomic cell disclosed in JP-A-2013-38382, the intensity of the EIT signal is small and thereby frequency stability is deteriorated.

SUMMARY

An advantage of some aspects of the invention is to provide an atomic cell manufacturing method and an atomic cell which are capable of improving frequency stability, and a quantum interference device, an atom oscillator, an electronic device, and a moving object which include the atomic cell.

The invention can be implemented as the following forms or application examples.

APPLICATION EXAMPLE 1

This application example is directed to an atomic cell manufacturing method including: a preparing process of preparing a structure that includes a wall portion which forms an inner space and at least a portion thereof is a light transmission portion, and in which liquid or solid metal atoms are disposed in the light transmission portion; and an adjusting process of adjusting distribution such that the metal atoms are distributed so as to be intensively disposed on an outer circumferential portion side of the light transmission portion compared to a center portion of the light transmission portion.

According to the atomic cell manufacturing method, in the obtained atomic cell, an amount of the liquid or solid metal atoms which are disposed at the center portion of the light transmission portion is small, and thus it is possible to cause the light to efficiently transmit through the atomic cell. For this reason, when the quantum interference device of the EIT method is used, for example, the intensity of the EIT signal can be enhanced, and thus it is possible to improve the frequency stability.

APPLICATION EXAMPLE 2

In the atomic cell manufacturing method according to the application example, it is preferable that, in the adjusting process, the distribution is adjusted by heating the light transmission portion.

With this configuration, it is possible to perform the adjusting process even in a state where the inner space is sealed.

APPLICATION EXAMPLE 3

In the atomic cell manufacturing method according to the application example, it is preferable that the preparing process includes a base portion preparing step of preparing abase portion which is open to one surface side, and includes a concave portion of which a bottom portion forms the light transmission portion, a disposing step of disposing metal atoms in the bottom portion, and a sealing step of sealing the concave portion so as to form the inner space.

With this configuration, it is possible to efficiently manufacture a compact atomic cell.

APPLICATION EXAMPLE 4

In the atomic cell manufacturing method according to the application example, it is preferable that in the disposing step, the metal atoms are deposited and disposed in the bottom portion.

With this configuration, even in a case of manufacturing the compact atomic cell, in the disposing step, it is possible to easily dispose a predetermined amount of the liquid or solid metal atoms in a desired position and range.

APPLICATION EXAMPLE 5

In the atomic cell manufacturing method according to the application example, it is preferable that, in the adjusting process, the metal atoms are adjusted so as to be disposed along the outer circumferential portion of the bottom portion.

With this configuration, it is possible to dispose the liquid or solid metal atoms in the outer circumferential portion of the window portion regardless of a large amount of the liquid or solid metal atoms which are disposed in the inner space.

APPLICATION EXAMPLE 6

In the atomic cell manufacturing method according to the application example, it is preferable that the bottom portion includes a corner in a planar view, and in the adjusting process, the metal atoms are adjusted so as to be disposed at the corner.

With this configuration, in the obtained atomic cell, it is possible to keep the liquid or solid metal atoms away from the light transmission area.

APPLICATION EXAMPLE 7

In the atomic cell manufacturing method according to the application example, it is preferable that, in the preparing process, the structure includes a recessed storage portion which is provided in the outer circumferential portion of the light transmission portion, and in the adjusting process, it is preferable that at least a portion of the metal atoms is disposed in the storage portion.

With this configuration, in the obtained atomic cell, it is possible to keep the liquid or solid metal atoms away from the light transmission area.

APPLICATION EXAMPLE 8

In the atomic cell manufacturing method according to the application example, it is preferable that the storage portion extends along the outer circumferential portion of the light transmission portion.

With this configuration, in the obtained atomic cell, it is possible to keep the liquid or solid metal atoms away from the light transmission area regardless of a large amount of the liquid or solid metal atoms which are disposed in the inner space.

APPLICATION EXAMPLE 9

This application example is directed to an atomic cell which is manufactured by the atomic cell manufacturing method according to the application example.

According to the atomic cell, an amount of the liquid or solid metal atoms which are disposed at the center portion of the light transmission portion is small, and it is possible to cause the light to efficiently transmit through the atomic cell. For this reason, when the quantum interference device of the EIT method is used, for example, the intensity of the EIT signal can be enhanced, and thus it is possible to improve the frequency stability.

APPLICATION EXAMPLE 10

This application example is directed to an atomic cell including a pair of window portions; a body portion which is disposed between the pair of window portions and forms an inner space together with the pair of window portions; and liquid or solid metal atoms are distributed in the inner space on at least one of the pair of window portions so as to be intensively disposed on an outer circumferential portion side of the window portion compared to a center portion of the window portion.

According to the atomic cell, an amount of the liquid or solid metal atoms which are disposed at the center portion of the light transmission portion (the window portion) is small, and thus it is possible to cause the light to efficiently transmit through the atomic cell. For this reason, when the quantum interference device of the EIT method is used, for example, the intensity of the EIT signal can be enhanced, and thus it is possible to improve the frequency stability.

APPLICATION EXAMPLE 11

It is preferable that the atomic cell according to the application example further includes a recessed storage portion which is provided in a connection portion of at least one of the pair of window portions and the body portion, and in which metal atoms are disposed.

With this configuration, it is possible to stably dispose the liquid or solid metal atoms in the outer circumferential portion of the window portion.

APPLICATION EXAMPLE 12

In the atomic cell according to the application example, it is preferable that the storage portion extends along the connection portion.

With this configuration, it is possible to stably dispose the liquid or solid metal atoms in the outer circumferential portion of the window portion regardless of a large amount of the liquid or solid metal atoms which are disposed in the inner space.

APPLICATION EXAMPLE 13

In the atomic cell according to the application example, it is preferable that the storage portion is formed by including a concave portion which is provided in the window portion.

With this configuration, it is possible to prevent the liquid or solid metal atoms which are projected from the storage portion from moving to the center portion of the window portion.

APPLICATION EXAMPLE 14

In the atomic cell according to the application example, it is preferable that the storage portion is formed by including a step portion which is provided in the body portion.

With this configuration, it is possible to keep the liquid or solid metal atoms away from the light transmission area.

APPLICATION EXAMPLE 15

This application example is directed to a quantum interference device including the atomic cell according to the application example.

With this configuration, it is possible to provide the quantum interference device having the excellent frequency stability.

APPLICATION EXAMPLE 16

This application example is directed to an atomic oscillator including the atomic cell according to the application example.

With this configuration, it is possible to provide the atomic oscillator having the excellent frequency stability.

APPLICATION EXAMPLE 17

This application example is directed to an electronic device including the atomic cell according to the application example.

With such a configuration, it is possible to provide the electronic device including the atomic cell which is capable of improving the frequency stability.

APPLICATION EXAMPLE 18

This application example is directed to a moving object including the atomic cell according to the application example.

With this configuration, it is possible to provide the moving object including the atomic cell which is capable of improving the frequency stability.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an atomic cell manufacturing method, an atomic cell, a quantum interference device, an atomic oscillator, an electronic device, and a moving object according to embodiments of the invention will be described based on embodiments shown in the accompanying drawings.

1. Atomic Oscillator (Quantum Interference Device)

First, an atomic oscillator according to the invention (the atomic oscillator including the quantum interference device according to the invention) will be described. Hereinafter, an example in which the quantum interference device of the invention is applied to the atomic oscillator is described, but the quantum interference device of the invention is not limited thereto, and for example, may be applied to a magnetic sensor, a quantum memory, or the like, in addition to the atomic oscillator.

First Embodiment

Figure 1:
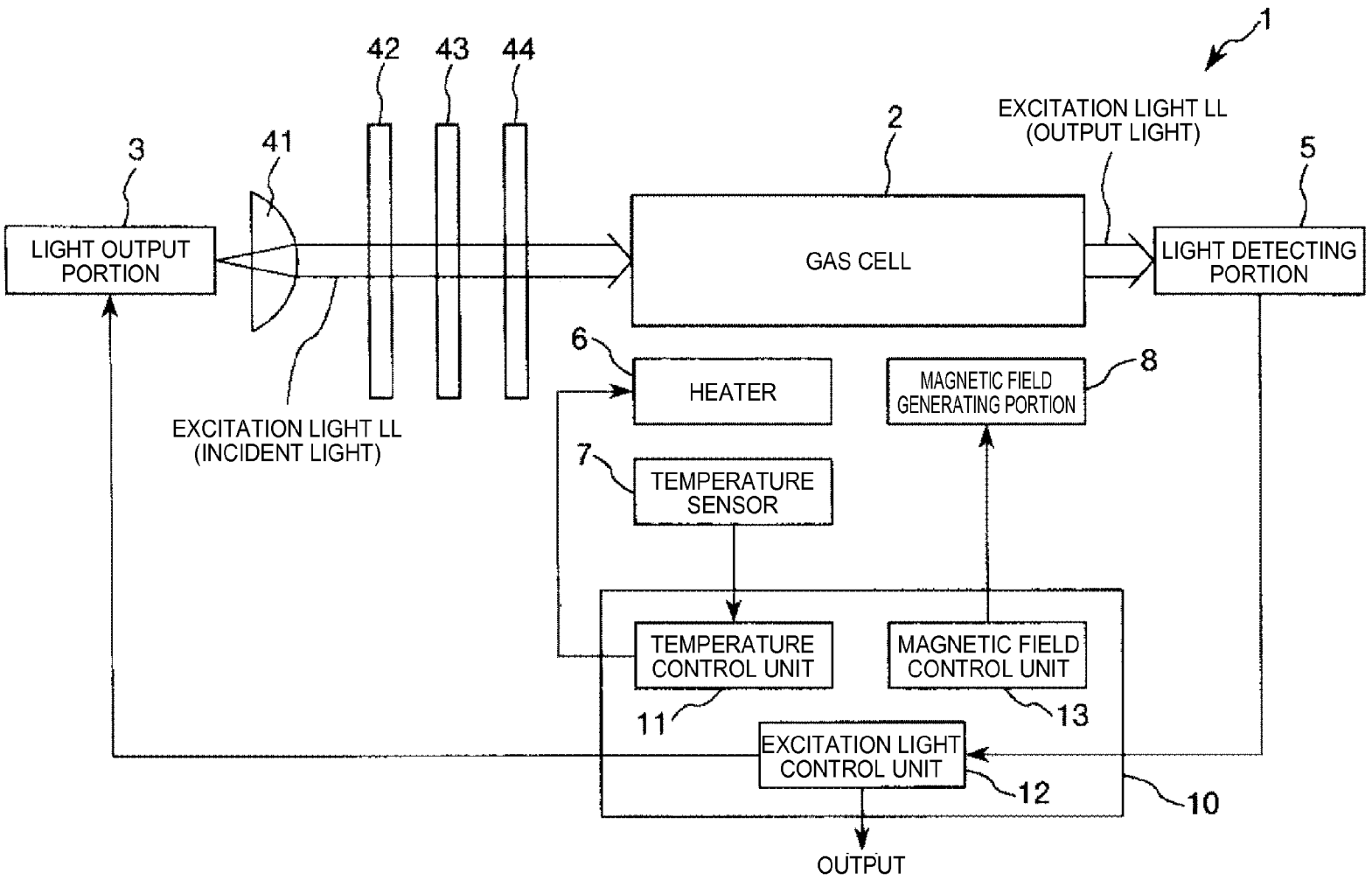
FIG. 1 is a schematic diagram illustrating an atomic oscillator (a quantum interference device) according to a first embodiment of the invention.
Figure 2:
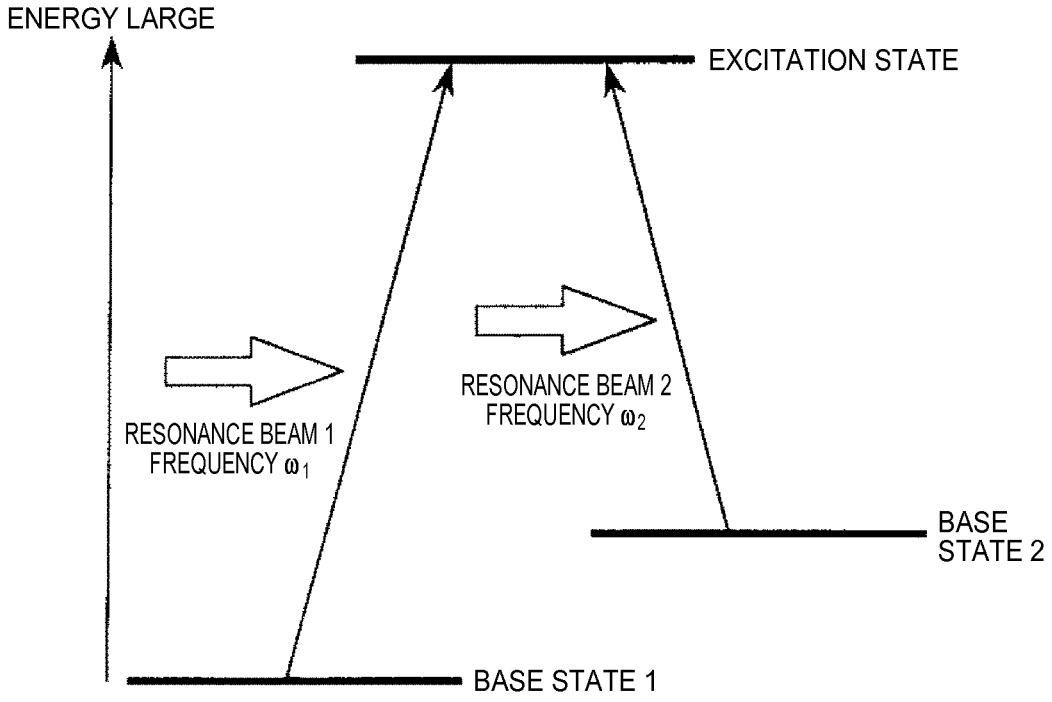
FIG. 2 is a diagram illustrating an energy state of an alkaline metal.
Figure 3:
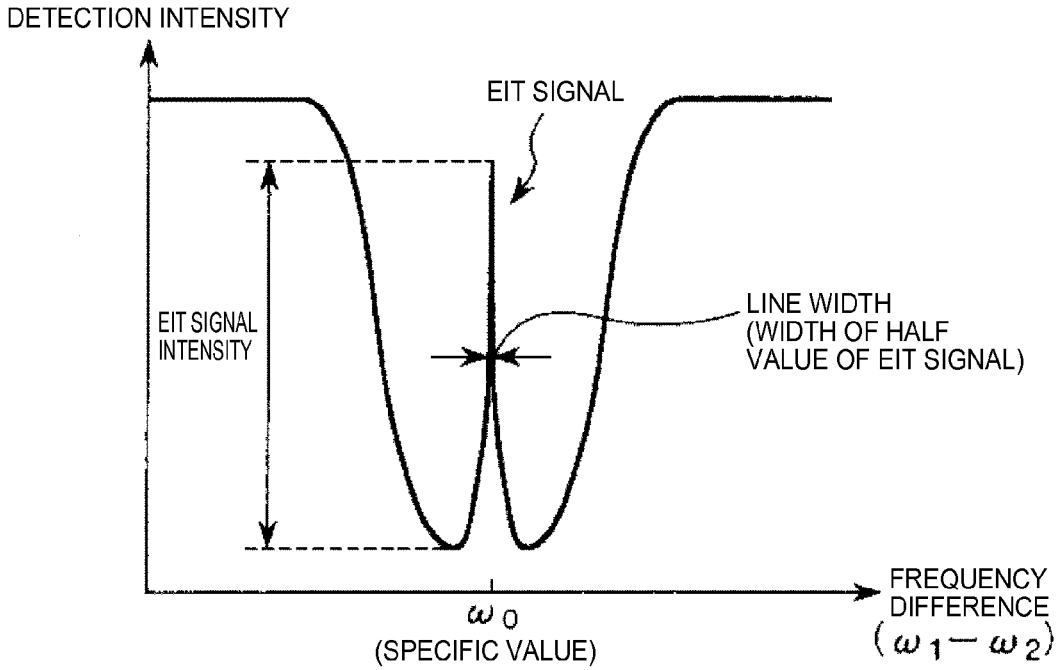
FIG. 3 is a graph illustrating a relationship of a frequency difference between two beams which are output from a light output portion and intensity of light which is detected by a light detecting portion.

FIG. 1 is a schematic diagram illustrating an atomic oscillator (quantum interference device) according to a first embodiment of the invention. FIG. 2 is a diagram illustrating an energy state of an alkaline metal, and FIG. 3 is a graph illustrating a relationship of a frequency difference between two beams which are output from a light output portion and intensity of light which is detected by a light detecting portion.

An atomic oscillator 1 shown in FIG. 1 is an atomic oscillator using coherent population trapping. As shown in FIG. 1, the atomic oscillator 1 includes an atomic cell 2 (gas cell), a light output portion 3, optical components 41, 42, 43, and 44, a light detecting portion 5, a heater 6, a temperature sensor 7, a magnetic field generating portion 8, and a control unit 10.

First, a principle of the atomic oscillator 1 will be briefly described.

as illustrated in FIG. 1, in the atomic oscillator 1, the light output portion 3 outputs the excitation light LL to the atomic cell 2, and the light detecting portion 5 detects the excitation light LL which transmits through the atomic cell 2.

The gaseous alkaline metal (metal atoms) is sealed in the atomic cell 2, and as illustrated in FIG. 2, the alkaline metal has energy levels of a 3-level system, and may show three states of two base states (base states 1 and 2) and an excitation state having different energy levels. Here, the base state 1 represents an energy state lower than the base state 2.

The excitation light LL output from the light output portion 3 has two resonance beams 1 and 2 having different frequencies, and when the aforementioned gaseous alkaline metal is irradiated with these two types of resonance beams 1 and 2, light absorptance (light transmittance) of the resonance beams 1 and 2 in the alkaline metal is changed according to a difference ($\omega_1-\omega_2$) between a frequency $\omega_1$ of the resonance beam 1 and a frequency $\omega_2$ of the resonance beam 2.

Further, when the difference ($\omega_1-\omega_2$) between the frequency $\omega_1$ of the resonance beam 1 and the frequency $\omega_2$ of the resonance beam 2 matches a frequency corresponding to an energy difference between the base state 1 and the base state 2, excitations from the base states 1 and 2 to the excitation state are respectively stopped. Here, both of the resonance beams 1 and 2 pass through the alkaline metal without being absorbed therein. Such a phenomenon is referred to as a CPT phenomenon or an electromagnetically induced transparency (EIT) phenomenon.

For example, if the frequency $\omega_1$ of the resonance beam 1 is fixed by the light output portion 3 and the frequency $\omega_2$ of the resonance beam 2 is changed, when the difference ($\omega_1-\omega_2$) between the frequency $\omega_1$ of the resonance beam 1 and the frequency $\omega_2$ of the resonance beam 2 matches a frequency $\omega_0$ corresponding to an energy difference between the base state 1 and the base state 2, a detection intensity of the light detecting portion 5 rapidly increases as shown in FIG. 3. Such a rapid signal is detected as an EIT signal. The EIT signal has a specific value determined by the type of the alkaline metal. Accordingly, it is possible to configure an oscillator by using such an EIT signal.

Hereinafter, each portion of the atomic oscillator 1 will be briefly described.

Atomic Cell

The alkaline metal such as the gaseous rubidium, cesium, or sodium is sealed in the atomic cell 2. Further, a noble gas such as argon or neon, or an inert gas such as nitrogen may be sealed in the atomic cell 2 as a buffer gas together with the alkaline metal gas, as necessary.

Here, surplus alkaline metals exist in the atomic cell 2 as liquid or solid materials. This point will be described below.

Light Output Portion

The light output portion 3 (a light source) has a function of outputting excitation light LL for exciting the alkaline metal atom in the atomic cell 2.

More specifically, the light output portion 3 outputs, as the excitation light LL, two beams (a resonance beam 1 and a resonance beam 2) having different frequencies as described above. The resonance beam 1 may excite (resonate) the alkaline metal in the atomic cell 2 from the above-described base state 1 to the excitation state. On the other hand, the resonance beam 2 may excite (resonate) the alkaline metal in the atomic cell 2 from the above-described base state 2 to the excitation state.

The light output portion 3 is not particularly limited as long as it can output the excitation light, but for example, a semiconductor laser such as a vertical cavity surface emitting laser (VCSEL), or the like may be used.

The light output portion 3 is adjusted into a predetermined temperature by a temperature adjustment element (not shown) (heat element, Peltier element, or the like).

Optical Component

The plurality of optical components 41, 42, 43, and 44 are provided on a light path of the excitation light LL between the above-mentioned light output portion 3 and the atomic cell 2, respectively. Here, the optical component 41, the optical component 42, the optical component 43, and the optical component 44 are sequentially disposed from the side of the light output portion 3 to the side of the atomic cell 2.

The optical component 41 is a lens. Thus, the excitation light LL may be applied to the atomic cell 2 without any waste. Meanwhile, the optical component 41 can be omitted.

The optical component 42 is a polarizing plate. Thus, it is possible to adjust polarization of the excitation light LL from the light output portion 3 in a predetermined direction.

The optical component 43 is a neutral density filter (ND filter). Thus, it is possible to adjust (reduce) the intensity of the excitation light LL incident into the atomic cell 2. Accordingly, even when the output of the light output portion 3 is high, it is possible to adjust the excitation light incident into the atomic cell 2 to a desired intensity of light. In the present embodiment, the intensity of the excitation light LL having polarization in a predetermined direction, passed through the above-described optical component 42, is adjusted by the optical component 43. Meanwhile, the optical component 43 can be omitted.

The optical component 44 is a $\lambda/4$ wavelength plate. Thus, the optical component 44 may convert the excitation light LL from the light output portion 3, from linearly polarized light into circularly polarized light (right-handed circularly polarized light or left-handed polarized light).

As will be described later, in a state where alkaline metal atoms in the atomic cell 2 are subject to Zeeman splitting by a magnetic field of the magnetic field generating portion 8, if excitation light which is linearly polarized light is applied to the alkaline metal atoms, the alkaline metal atoms are equivalently dispersed and existed at plural levels obtained by the Zeeman splitting through interaction between the excitation light and the alkaline metal atoms. As a result, the number of alkaline metal atoms at a desired energy level is relatively reduced compared with the number of alkaline metal atoms at other energy levels. Thus, the number of atoms for exhibiting a desired EIT phenomenon is reduced, and the intensity of a desired EIT signal is reduced. As a result, the oscillation characteristics of the atomic oscillator 1 deteriorate.

On the other hand, in a state where alkaline metal atoms in the atomic cell 2 are subject to Zeeman splitting by a magnetic field of the magnetic field generating portion 8 as described below, if excitation light which is circularly polarized light is applied to the alkaline metal atoms, it is possible to relatively increase the number of alkaline metal atoms at a desired energy level among plural levels obtained by the Zeeman splitting compared with the number of alkaline metal atoms at other energy levels through interaction between the excitation light and the alkaline metal atoms. Thus, the number of atoms for exhibiting a desired EIT phenomenon is increased, and the intensity of a desired EIT signal is increased. As a result, it is possible to enhance the oscillation characteristics of the atomic oscillator 1.

Light Detecting Portion

The light detecting portion 5 has a function of detecting the intensity of the excitation light LL (the resonance beams 1 and 2) having passed through the inside of the atomic cell 2.

The light detecting portion 5 is not particularly limited as long as it can detect excitation light as described above but for example, a light detector (light receiving element) such as a solar cell or a photodiode may be used.

Heater

The heater 6 (heating portion) has a function of heating the above-mentioned atomic cell 2 (more specifically, the alkaline metal in the atomic cell 2). Thus, it is possible to maintain the alkaline metal in the atomic cell 2 in a gas form of an appropriate concentration.

The heater 6 is configured to include a heat resistor which is heated by, for example, electrification. The heat resistor may be provided by coming in contact with the atomic cell 2, or may be provided with respect to the atomic cell 2 in non-contact state.

For example, when the heat resistor is provided by coming in contact with the atomic cell 2, the heat resistor is provided in each of the window portions of the atomic cell 2. With this, it is possible to prevent alkaline metal atoms from being condensed in the window portions of the atomic cell 2. As a result, it is possible to enhance the characteristics (oscillation characteristic) of the atomic oscillator 1 over a long period of time. The heat resistor may be formed of a material having a light transmitting property with respect to the excitation light. Specifically, for example, a transparent electrode material such as an oxide such as indium tin oxide (ITO), indium zinc oxide (IZO), $In_3O_3$, $SnO_2$, Sb-containing $SnO_2$, or Al-containing ZnO may be used. In addition, the heat resistor may be formed using, for example, a chemical vapor deposition (CVD) such as a plasma CVD or a thermal CVD, a dry plating method such as a vacuum deposition, a sol-gel method, or the like.

In addition, when the heat resistor is provided with respect to the atomic cell 2 in a non-contact state, the heat resistor may transfer heat to the atomic cell 2 via a material such as metal which is excellent in thermal conductivity or ceramics.

The heater 6 is not limited to the above-described configuration as long as it can heat the atomic cell 2, and various heaters may be used. In addition, the atomic cell 2 may be heated using a Peltier element together with the heater 6, or instead of the heater 6.

Temperature Sensor

The temperature sensor 7 detects the temperature of the heater 6 or the atomic cell 2. Further, a heating value of the heater 6 is controlled based on the detection result of the temperature sensor 7. Thus, it is possible to maintain alkaline metal atoms in the atomic cell 2 at a desired temperature.

An installation position of the temperature sensor 7 is not particularly limited. For example, the temperature sensor 7 may be provided on the heater 6 or on an external surface of the atomic cell 2.

The temperature sensor 7 is not particularly limited, and known various temperature sensors such as a thermistor or a thermocouple may be used.

Magnetic Field Generating Portion

The magnetic field generating portion 8 has a function of generating a magnetic field for Zeeman-splitting retracted plural energy levels of the alkaline metal in the atomic cell 2. Thus, it is possible to enlarge a gap between different energy levels of the alkaline metal by the Zeeman splitting, to thereby enhance a resolving power. Asa result, it is possible to enhance the accuracy of an oscillation frequency of the atomic oscillator 1.

The magnetic field generating portion 8 is configured by Helmholtz coils disposed so that the atomic cell 2 is interposed therebetween, or a solenoid coil disposed to cover the atomic cell 2, for example. Thus, it is possible to generate a uniform magnetic field in one direction in the atomic cell 2.

Further, the magnetic field generated by the magnetic field generating portion 8 is a constant magnetic field (a direct current magnetic field), but an alternating current magnetic field may be overlapped therewith.

Control Unit

The control unit 10 has a function of respectively controlling the light output portion 3, the heater 6, and the magnetic field generating portion 8.

The control unit 10 includes an excitation light control unit 12 that controls frequencies of the resonance beams 1 and 2 of the light output portion 3, a temperature control unit 11 that controls the temperature of the alkaline metal in the atomic cell 2, and a magnetic field control unit 13 that controls a magnetic field from the magnetic field generating portion 8.

The excitation light control unit 12 controls frequencies of the resonance beams 1 and 2 output from the light output portion 3 based on the detection result of the above-described light output portion 5. More specifically, the excitation light control unit 12 controls the frequencies of the resonance beams 1 and 2 output from the light output portion 3 so that the frequency difference $(\omega_1-\omega_2)$ becomes the frequency $\omega_0$ specific to the alkaline metal.

Here, the excitation light control unit 12 includes a voltage control type quartz oscillator (an oscillation circuit) (not shown), and outputs an output signal of the voltage control type quartz oscillator as an output signal of the atomic oscillator 1 while performing synchronizing and adjusting an oscillation frequency of the voltage control type quartz oscillator based on the detection result of the light detecting portion 5.

For example, the excitation light control unit 12 includes a multiplier (not shown) for performing frequency multiplication on the output signal from the voltage control type quartz oscillator, and a signal (a high frequency signal) which is multiplied by this multiplier is superimposed on a DC bias current so as to be input to the light output portion 3 as a driving signal. Due to this, when the voltage control type quartz oscillator is controlled so as to detect the EIT signal in the light detecting portion 5, a desired frequency signal is output from the voltage control type quartz oscillator. When a desired frequency of the output signal from the atomic oscillator 1 is f, for example, a multiplication rate of the multiplier is $\omega_0/(2\times f)$. Therefore, when the oscillation frequency of the voltage control type quartz oscillator is set to be f, it is possible to output two light beams in which the frequency difference $(\omega_1-\omega_2)$ becomes $\omega_0$ by modulating a light emitting element such as a semiconductor laser included in the light output portion 3 using the signal from the multiplier.

Further, the temperature control unit 11 controls electrification to the heater 6 based on the detection result of the temperature sensor 7. Thus, it is possible to maintain the atomic cell 2 in a desired temperature range. For example, a temperature of the atomic cell 2 is adjusted to be about 70° C. by the heater 6.

In addition, the magnetic field control unit 13 controls electrification to the magnetic field generating portion 8 so that a magnetic field generated by the magnetic field generating portion 8 becomes uniform.

The control unit 10 having such a configuration is provided in an IC chip mounted on a board, for example.

As described above, the configuration of each portion of the atomic oscillator 1 has been briefly described.

Detailed Description of Atomic Cell

Figure 4A:
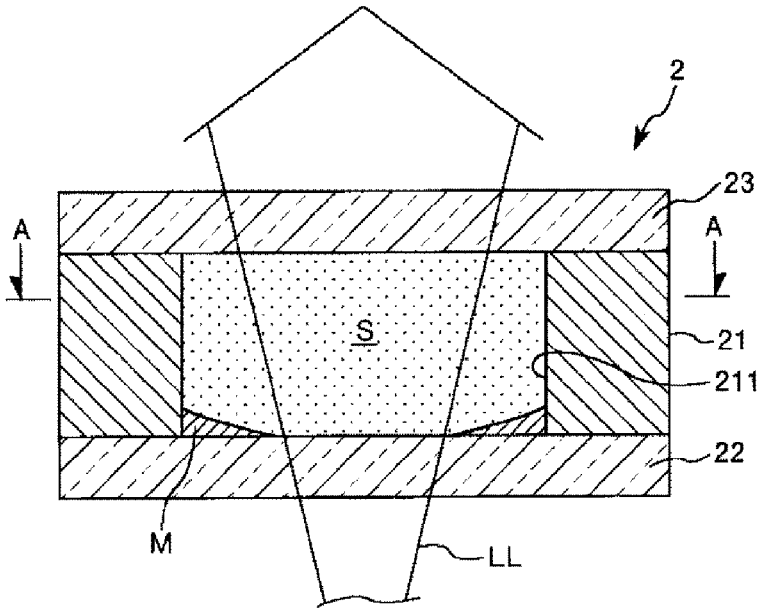
FIG. 4A is a longitudinal sectional view of an atomic cell which is included in the atomic oscillator as illustrated in FIG. 1.
Figure 4B:
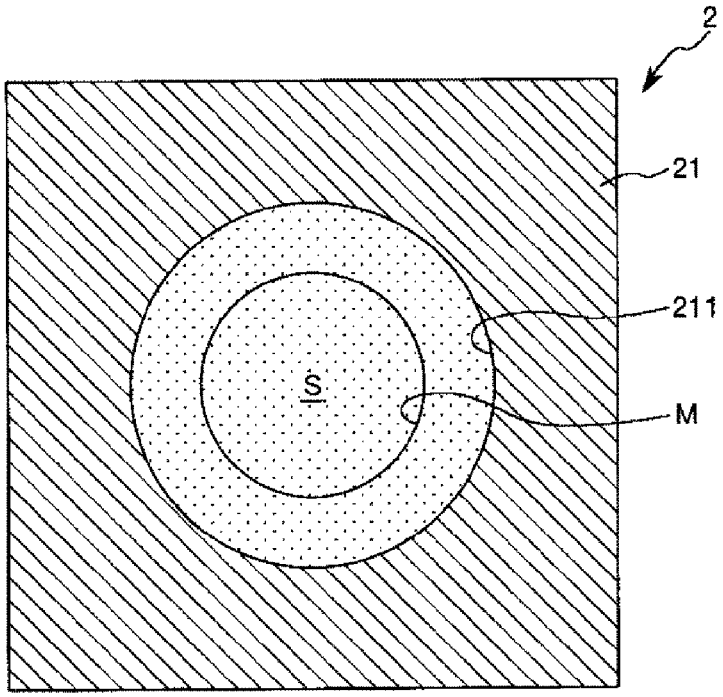
FIG. 4B is a sectional view (cross-sectional view) taken along line A-A in FIG. 4A.
Figure 5:
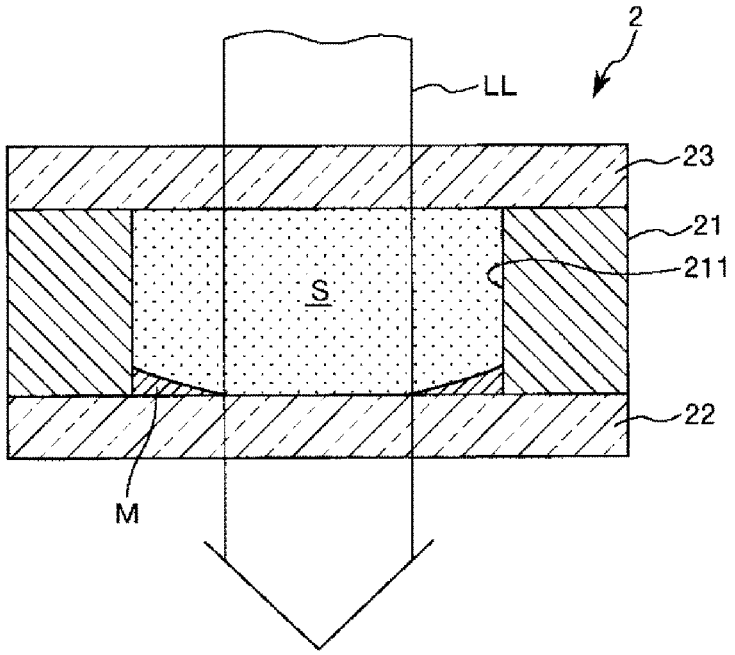
FIG. 5 is a longitudinal sectional view illustrating another example of using the atomic cell which is included in the atomic oscillator as illustrated in FIG. 1.

FIG. 4A is a longitudinal sectional view of an atomic cell which is included in the atomic oscillator as illustrated in FIG. 1, and FIG. 4B is a sectional view (cross-sectional view) taken along line A-A in FIG. 4A. FIG. 5 is a longitudinal sectional view illustrating another example of using the atomic cell which is included in the atomic oscillator as illustrated in FIG. 1.

Note that, hereinafter, for convenience of explanation, in FIG. 4A, the upper side is referred to as "up" and the lower side is referred to as "down".

As illustrated in FIG. 4A, the atomic cell 2 includes a body portion 21, and a pair of window portions 22 and 23 which interpose the body portion 21 therebetween. In the atomic cell 2, the body portion 21 is disposed between the pair of window portions 22 and 23, and the inner space S in which the gaseous alkaline metal is sealed is formed (configured) by being partitioned off by the body portion 21 and the pair of window portions 22 and 23.

In addition, on the window portion 22 in the inner space S, the liquid or gaseous alkaline metals M (metal atom) are distributed so as to be intensively disposed on the outer circumferential portion side compared to the center portion of the window portion 22.

Here, a "wall portion" which forms the inner space S is formed of the body portion 21 and the window portions 22 and 23, and a "light transmission portion" is formed of each portion which is a part of the wall portion, and corresponds to the inner space S of the window portions 22 and 23.

The body portion 21 is formed into a plate shape of which a vertical direction corresponds to a thickness direction, and the body portion 21 is formed of through holes 211 passing through the thickness direction (the vertical direction) of the body portion 21.

A material for forming the body portion 21 is not particularly limited, and examples of the material include a glass material, crystal, a metal material, a resin material, or a silicon material. Among these, it is preferable to use any one of the glass material, the crystal, and the silicon material, and it is more preferable to use the silicon material. Therefore, even when a compact atomic cell 2 of which the width and the height are equal to or smaller than 10 mm is formed, the body portion 21 may be easily formed with high accuracy using a micro processing technique such as etching. Particularly, it is possible to perform the micro processing on the silicon by etching. Accordingly, even in a case where the miniaturization of the atomic cell 2 is realized by forming the body portion 21 with the silicon, it is possible to simply form the body portion 21 with high accuracy. In addition, if the body portion 21 is formed of silicon, when the window portions 22 and 23 are formed of the glass material, the body portion 21 may be simply and air-tightly bonded to the window portions 22 and 23 using an anodic bonding method, thereby realizing the atomic cell 2 with the excellent reliability.

The window portion 22 is bonded to the lower surface of the body portion 21, whereas the window portion 23 is bonded to the upper surface of the body portion 21. Due to this, lower end openings of the through holes 211 are blocked by the window portion 22, and upper end openings of the through holes 211 are blocked by the window portion 23. In addition, the inner space S which is formed of the through holes 211 is formed as an airtightly sealed space.

A bonding method of the body portion 21 and the window portions 22 and 23 is determined according to materials of these components, and is not particularly limited as long as the components can be air-tightly bonded. For example, a bonding method using an adhesive, a direct bonding method, an anodic bonding method, a surface activation bonding method, or the like may be used. Among these, it is preferable to use the direct bonding method or the anodic bonding method. By using this method, the body portion 21 may be simply and air-tightly bonded to the window portions 22 and 23, thereby realizing the atomic cell 2 with the excellent reliability.

Each of the window portions 22 and 23, which is bonded to the body portion 21 has a light transmitting property with respect to the excitation light LL from the above-described light output portion 3. In addition, the window portion 22 on one side is an incident side window portion through which the excitation light LL is incident into the inner space S of the atomic cell 2, and the window portion 23 on the other side is an output side window portion through which the excitation light LL is output from the inner space S of the atomic cell 2.

In addition, the window portions 22 and 23 are respectively formed into the plate shape.

A material for forming the window portions 22 and 23 is not particularly limited as long as a material has the aforementioned light transmitting property with respect to the excitation light, and examples of the material include a glass material, crystal, and the like, and it is preferable to use the glass material. With this material, it is possible to realize the window portions 22 and 23 having the light transmitting property with respect to excitation light. In addition, when the body portion 21 is formed of silicon, the window portions 22 and 23 are formed of glass, and thus the body portion 21 may be simply and air-tightly bonded to the window portions 22 and 23 using the anodic bonding method, thereby realizing the atomic cell 2 with the excellent reliability. Meanwhile, the window portions 22 and 23 can be formed of silicon depending on the thickness of the window portions 22 and 23 and the intensity of the excitation light. In this case, the window portions 22 and 23 can be directly bonded to the body portion 21.

The gaseous alkaline metal is accommodated in the inner space S which is partitioned off by the body portion 21 and the window portions 22 and 23. The gaseous alkaline metal which is accommodated in the inner space S is excited by the excitation light LL. That is, at least a portion of the space in the through hole 211 forms a "light transmitting space" through which the excitation light LL passes. In the embodiment, the cross-section of the through hole 211 is formed into a circular shape, and the cross-section of light transmitting space (not shown) is formed into a shape (that is, the circular shape) similar to the cross-section of the through hole 211, and is set to be slightly smaller than the cross-section of the through hole 211. Meanwhile, the cross-sectional shape of the through hole 211 is not limited to the circular shape, and may be a polygonal shape such as a quadrangle or a pentagon, an elliptical shape, or the like, for example.

In addition, a liquid or solid alkaline metal M is accommodated in an inner space S. The alkaline metal M is disposed on the surface on the inner space S side of the window portion 22. The liquid or solid alkaline metal M and the gaseous alkaline metal in the inner space S are in a state of equilibrium under a saturated vapor pressure. With this, it is possible to keep the gaseous alkaline metal in the inner space S in a predetermined concentration.

Particularly, the alkaline metal M is disposed in the outer circumferential portion of the window portion 22. In the embodiment, the alkaline metal M is disposed over the entire circumference along the outer circumferential portion of the window portion 22. With this, when the excitation light LL transmits through the window portion 22, it is possible to prevent the excitation light LL from being shielded by the alkaline metal M. Therefore, it is possible to efficiently excite the gaseous alkaline metal in the inner space S by the excitation light LL, and to enhance the intensity of the EIT signal. As a result, it is possible to improve the frequency stability.

In addition, the thickness of the alkaline metal M becomes gradually larger in the direction from the center portion to the outer circumferential portion side of the window portion 22. Then, the surface on the side opposite to the window portion 22 of the alkaline metal M is curved. In this way, the alkaline metals Mare intensively disposed on the outer circumferential portion side compared to the center portion of the window portion 22.

Here, if it is necessary to shorten the distance between the atomic cell 2 and the light output portion 3 for realizing the miniaturization of the atomic oscillator 1, it is difficult to make the excitation light LL become parallel light in the inner space S even when the lens is disposed between the atomic cell 2 and the light output portion 3, and the width of the excitation light LL becomes larger in the direction from the incidence side to the output side in the inner space S as illustrated in FIG. 4A. Accordingly, the width of the excitation light LL in the window portion 22 is smaller than the excitation light LL in the window portion 23. For this reason, in a case where the excitation light LL is incident from the window portion 22, even when the alkaline metal M is disposed in the outer circumferential portion of the window portion 22, it is possible to prevent the excitation light LL from being shielded by the alkaline metal M when the excitation light LL transmits through the window portion 22, and to increase the amount of the gaseous alkaline metal which is irradiated with the excitation light LL in the inner space S. In addition, the same is true for a case where the lens is not disposed between the atomic cell 2 and the light output portion in order to realize the miniaturization of the atomic oscillator 1.

Meanwhile, as illustrated in FIG. 5, it is possible to use the window portion 23 as the window portion on the incidence side, on which the excitation light LL is incident into the inner space S of the atomic cell 2, and to use the window portion 22 as the window portion on the output side, on which the excitation light LL is outputted from the inner space S of the atomic cell 2. In this case, when the incident excitation light LL acts on the gaseous alkaline metal before the incident excitation light LL acts on the liquid or solid alkaline metal, it is possible to decrease the deterioration of the characteristics of the excitation light LL.

Note that, in FIG. 5, the alkaline metal M is not disposed at the center portion of the window portion 22, but the liquid or solid alkaline metal may be disposed at the center portion of the window portion 22 as long as the thickness of the alkaline metal is smaller than that of the liquid or solid alkaline metal which is disposed in the outer circumferential portion of the window portion 22, and the thickness thereof is sufficient to obtain the required intensity of the EIT signal.

According to the atomic cell 2 as described above, an amount of the liquid or solid alkaline metals M which are disposed at the center portion of the window portion 22 is small, and thus it is possible to cause the light to efficiently transmit through the atomic cell. For this reason, the intensity of the EIT signal can be enhanced, and thus it is possible to improve the frequency stability.

The atomic cell 2 which is included in the above-described atomic oscillator 1 can be manufactured as follows.

Atomic Cell Manufacturing Method

Hereinafter, the manufacturing method of the atomic cell according to the invention will be described by exemplifying a case of manufacturing the aforementioned atomic cell 2. Note that, in the following description, the body portion 21 is formed of silicon, and an example in a case where the window portions 22 and 23 are formed of glass will be described.

Figure 6A:
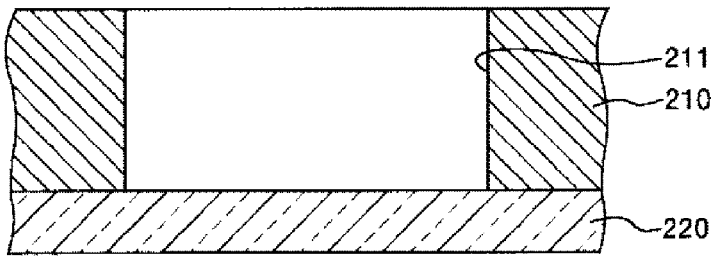
FIGS. 6A to 6C are diagrams illustrating a preparing process (a disposing step), and a sealing step in the atomic cell manufacturing method as illustrated in FIGS. 4A and 4B.
Figure 6B:
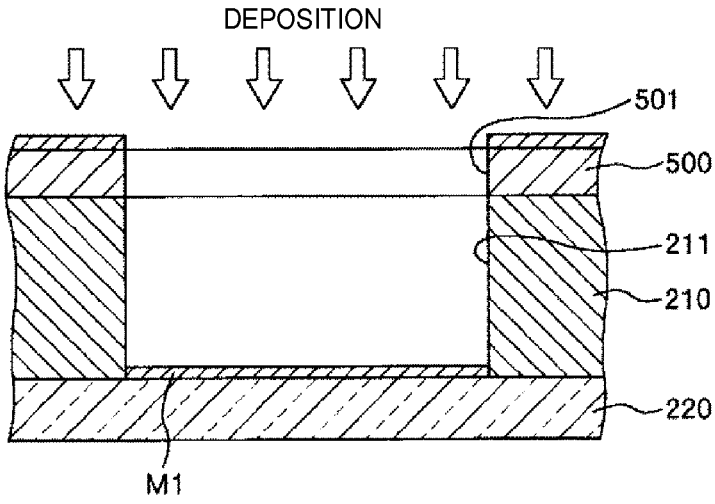
Figure 6C:
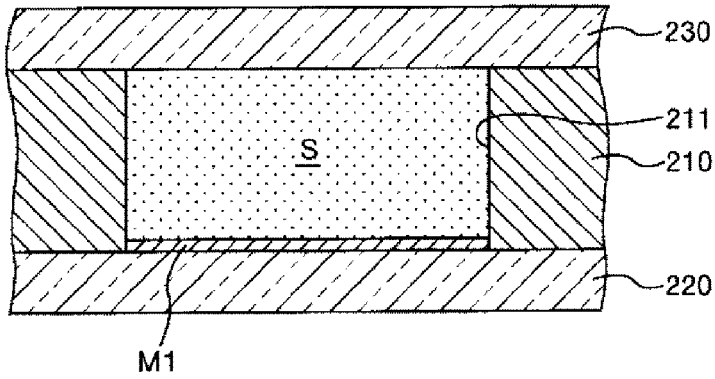

FIGS. 6A to 6C are diagrams illustrating a preparing process (the disposing step), and a sealing step in the manufacturing method of the atomic cell as illustrated in FIGS. 4A and 4B, and FIGS. 7A and 7B are diagrams illustrating an adjusting process and an individualizing process in the manufacturing method of the atomic cell as illustrated in FIGS. 4A and 4B.

The manufacturing method of the atomic cell 2 includes 1. Preparing process, 2. Adjusting process, and 3. Individualizing process. Hereinafter, each process will be described in order.

1. Preparing Process 1-1. First Bonding Process (Base Portion Preparing Step)

First, as illustrated in FIG. 6A, a substrate for forming body portion 210 and a substrate for forming window portion 220 are bonded to each other.

Here, a structure which is formed of the substrate for forming body portion 210 and the substrate for forming window portion 220 includes a concave portion which is formed that one end opening of the through hole 211 is blocked by the substrate for forming window portion 220, and forms a "base portion". The concave portion opens to one side surface of the structure and the bottom portion thereof forms the light transmission portion.

The substrate for forming body portion 210 corresponds to a silicon substrate for forming the body portion 21 described above, and includes the through hole 211. In addition, the substrate for forming window portion 220 corresponds to a glass substrate for forming the window portion 22 described above.

In the embodiment, the substrate for forming body portion 210 which includes a plurality of pairs of the through holes 211 is individualized in 3. Individualizing process described below so as to be the body portion 21. In addition, the substrate for forming window portion 220 is individualized in 3. Individualizing process described below so as to be the window portion 22. Here, a bonded body (laminated body) obtained by bonding the substrate for forming body portion 210 and the substrate for forming window portion 220 forms a "base portion" including a concave portion opens to one side surface of the structure by the through hole 211.

It is preferable that the substrate for forming body portion 210 and the substrate for forming window portion 220 are bonded to each other by anodic bonding which is one kind of heat bonding. In this way, it is possible to air-tightly bond the substrate for forming body portion 210 and the substrate for forming window portion 220 in a relatively simple manner.

1-2. Disposing Step

Next, as illustrated in FIG. 6B, the alkaline metal M1 is disposed on the bottom portion of the concave portion by the through hole 211. More specifically, the use of a mask 500 including an opening portion 501 allows the alkaline metal M1 to be deposited on the surface which is opened into the through hole 211 of the substrate for forming window portion 220 through a vapor phase film deposition method. With this, it is possible to simply dispose the alkaline metal M1 having a predetermined amount with high accuracy.

Here, the opening portion 501 which is formed in the mask 500 is formed in such a manner that the alkaline metal M1 is prevented from being attached on the upper surface of the substrate for forming body portion 210. In the embodiment, the opening portion 501 is formed so as to match with the opening of the through hole 211. Note that, the opening portion 501 of the mask 500 may have smaller width compared to the opening of the through hole 211.

A constituent material of the mask 500 is not particularly limited, but it is preferable to use silicon. That is, it is preferable to use a silicon substrate as the mask 500. With this, it is possible to realize the mask 500 including the opening portion 501 of which the position and the size are highly accurate.

In addition, as a deposition method of the alkaline metal M1, among the vapor phase film deposition methods, it is preferable to employ an evaporation method. With this, it is possible to dispose the alkaline metal M1 on the substrate for forming window portion 220 while reducing a chemical change of the alkaline metal M.

Further, in addition to the vapor phase film deposition method, a predetermined volume of the liquid alkaline metal may be injected by using a pipette, or the solid alkaline metal may be weighed and disposed. Alternatively, the alkaline metal such as a nitride may be weighed and disposed. In this case, it is possible to dispose the alkaline metal M1 by reducing a compound after the sealing step and before the adjusting process.

1-3. Second Bonding Process (Sealing Step)

Next, as illustrated in FIG. 6C, the substrate for forming body portion 210 (one surface side of the first substrate) and a substrate for forming window portion 230 are bonded to each other. Therefore, the inside of the concave portion which is formed in the through hole 211 is sealed so as to form the inner space S.

Here, the substrate for forming window portion 230 forms a "lid portion" which is bonded to the base portion including the concave portion. In addition, a "wall portion" which forms the inner space S is formed of the substrate for forming body portion 210 and the substrates for forming window portion 220 and 230, and a "light transmission portion" is formed of each portion which is a part of the wall portion, and corresponds to the inner space S of the substrates for forming window portion 220 and 230. Then, the liquid or solid alkaline metal M1 is disposed in the light transmission portion as described above.

The substrate for forming window portion 230 is a glass substrate for forming the aforementioned window portion 23. In addition, the substrate for forming window portion 230 corresponds to the window portion 23 by being individualized in 3. Individualizing process described below. Here, the substrate for forming window portion 230 forms a "second substrate" which is bonded to the first substrate formed of the substrate for forming body portion 210 and the substrate for forming window portion 220 described above.

As the bonding method of the substrate for forming body portion 210 and the substrate for forming window portion 230, it is possible to use the same bonding method as the aforementioned bonding method of the substrate for forming body portion 210 and the substrate for forming window portion 230. That is, in the sealing step (1-3), it is possible to bond the substrate for forming body portion 210 and the substrate for forming window portion 230 by using an anodic bonding method which is one of the heat bonding methods.

2. Adjusting Process

Figure 7A:
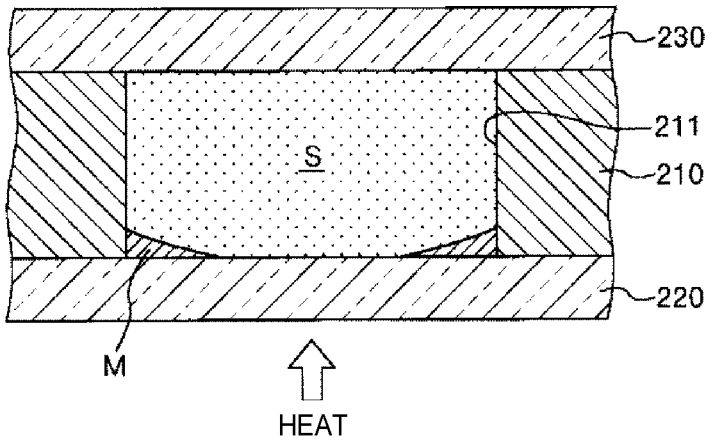
FIGS. 7A and 7B are diagrams illustrating an adjusting process and an individualizing process in the atomic cell manufacturing method as illustrated in FIGS. 4A and 4B.

Next, as illustrated in FIG. 7A, the distribution of an amount of the alkaline metal M1 is adjusted by heating the substrate for forming window portion 220. At that time, a center portion of a portion through which the excitation light LL of the substrate for forming window portion 220 (hereinafter, simply referred to as the "center portion") transmits is intensively heated. With this, it is possible to move the alkaline metal M1 on the center portion of the substrate for forming window portion 220 to the outer circumferential portion side of the substrate for forming window portion 220. As a result, the alkaline metals M are distributed so as to be intensively disposed on the outer circumferential portion side compared to the center portion of the substrate for forming window portion 220.

The heating method used in this process is not particularly limited as long as it is preferable to adjust the distribution of the amount of the alkaline metal, but it is preferable to use laser (an energy line). Accordingly, it is possible to partially heat the center portion of the substrate for forming window portion 220. For this reason, it is possible to efficiently heat and move the alkaline metal which is disposed at the center portion of the substrate for forming window portion 220 to the outer circumferential portion of the substrate for forming window portion 220.

In addition, in order to efficiently heat the alkaline metal, a wavelength region of the laser is preferably an infrared region. Meanwhile, the heating method used in the process is not limited to the laser. For example, light other than the laser, electromagnetic waves such as an X-ray, or a gamma ray, an electron beam, a particle beam such as an ion beam, or a combination of two or more of these energy lines may be used.

In addition, as the heating method used in the process, a tip end of a heated rod-shape pin may come in contact with the center portion.

3. Individualizing Process

Figure 7B:
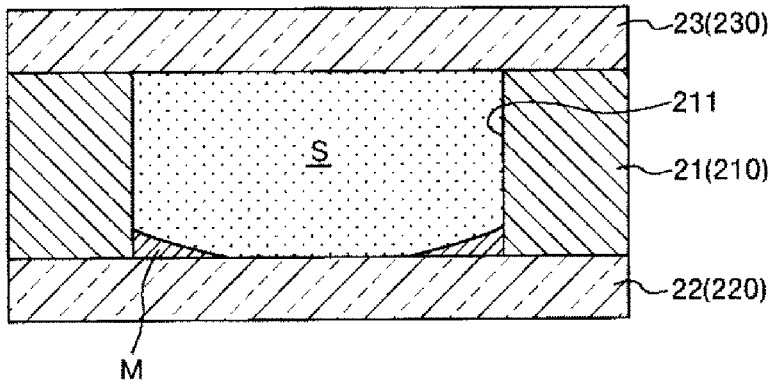

Next, the stacked structure (the bonded body) which is formed of the substrate for forming body portion 210 and the substrates for forming window portion 220 and 230 is individualized by, for example, dicing. With this, the atomic cell 2 can be obtained as illustrated in FIG. 7B.

In the embodiment, as described above, in 1. Preparing process, the first substrate includes a plurality of concave portions formed of the through holes 211 and in 3. Individualizing process, the bonded body obtained by bonding the first substrate and the second substrate, that is, the bonded body obtained by bonding the substrate for forming body portion 210 and the substrates for forming window portion 220 and 230 is individualized for each concave portion formed of the through holes 211. With this processes, it is possible to efficiently manufacture the atomic cell.

In addition, in a case where 3. Individualizing process is performed after 2. Adjusting process, that is, 2. Adjusting process is performed before 3. Individualizing process, it is possible to efficiently perform 2. Adjusting process.

According to the manufacturing method of the atomic cell 2 as described above, it is possible to obtain the atomic cell 2 which exhibits the above-described effects. That is, in the obtained atomic cell 2, an amount of the liquid or solid alkaline metals M which are disposed at the center portion of the light transmission portion is small, and thus it is possible to cause the light to efficiently transmit through the atomic cell. For this reason, the intensity of the EIT signal can be enhanced, and thus it is possible to improve the frequency stability.

In addition, in the manufacturing method of the atomic cell 2 as described above, 1. Preparing process includes the base portion preparing step (1-1), the disposing step (1-2), and the sealing step (1-3), that is, the wall portion which forms the inner space S which has partitioned off by bonding a plurality of substrates, and thus it is possible to efficiently manufacture a compact atomic cell 2 by using a MEMS technique, for example.

Particularly, in the manufacturing method described above, since the substrate for forming body portion 210 includes silicon, each of the substrates for forming window portion 220 and 230 includes glass, it is possible to manufacture the compact atomic cell 2 with high accuracy using an etching technique and a photolithography technique.

In addition, in the disposing step (1-2), the alkaline metals M1 are deposited and disposed in the bottom portion of the concave portion which is formed by the through hole 211, and thus in a case where the compact atomic cell 2 is manufactured by using, for example, the above described MEMS technique or the like, in the disposing step (1-2), it is possible to easily dispose a predetermined amount of the liquid or solid alkaline metals M1 in a desired position and range.

In addition, in 2. Adjusting process, the alkaline metals M are adjusted so as to be disposed along the outer circumferential portion of the bottom portion of the concave portion which is formed by the through hole 211, it is possible to dispose the liquid or solid alkaline metals M in the outer circumferential portion of the window portion 22 regardless of a large amount of the liquid or solid alkaline metals M which are disposed in the inner space S.

Second Embodiment

Next, a second embodiment of the invention will be described.

Figure 8A:
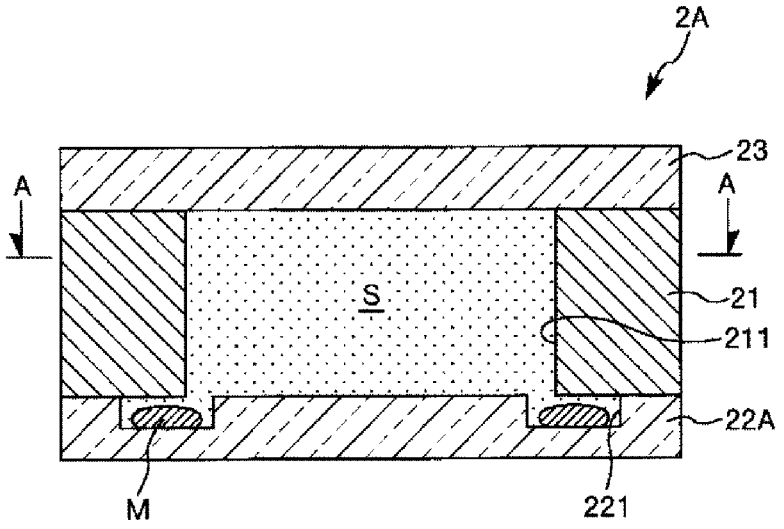
FIG. 8A is a longitudinal sectional view of an atomic cell which is included in an atomic oscillator according to a second embodiment of the invention.
Figure 8B:
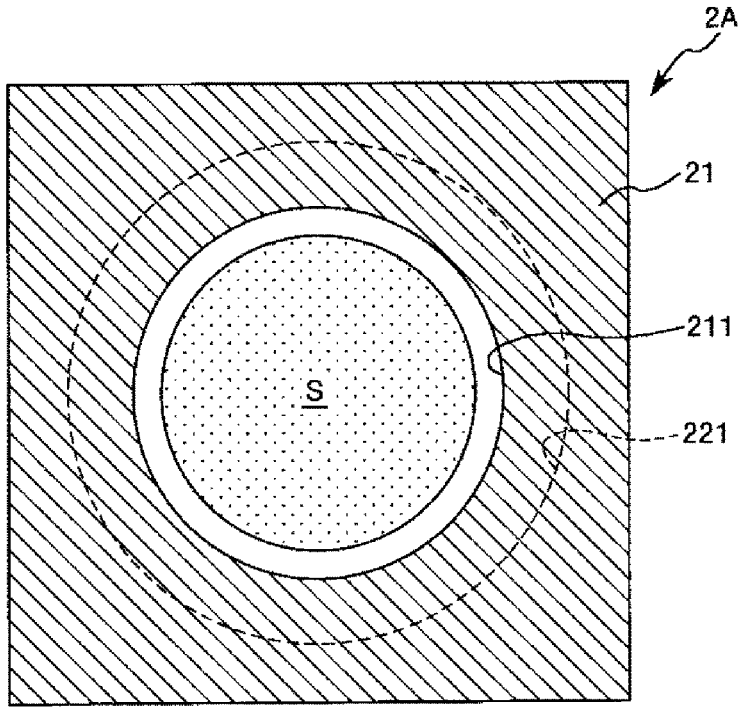
FIG. 8B is a sectional view (cross-sectional view) taken along line A-A in FIG. 8A.

FIG. 8A is a longitudinal sectional view of the atomic cell which is included in an atomic oscillator according to the second embodiment of the invention, and FIG. 8B is a sectional view (cross-sectional view) taken along line A-A in FIG. 8A.

The present embodiment has the same configuration as in the first embodiment except for a configuration of one window portion and a disposition of the liquid or solid alkaline metal.

Note that, in the following description, the description of the second embodiment will focus on the differences from the embodiment described above and the same matters will be omitted.

As illustrated in FIGS. 8A and 8B, an atomic cell 2A includes the body portion 21, and a pair of window portions 22A and 23 which interpose the body portion 21 therebetween.

An annular concave portion 221 (a groove) is formed on the surface of the body portion 21 side of the window portion 22A along the wall surface of the through hole 211 in the body portion 21. When viewing from the thickness direction of the window portion 22A, as illustrated in FIGS. 8A and 8B, an inner circumferential edge of the concave portion 221 is positioned on the inner side from the wall surface of the through hole 211, and an outer circumferential edge of the concave portion 221 is positioned on the outer side from the wall surface of the through hole 211.

The liquid or solid alkaline metal M is disposed in the concave portion 221. When the alkaline metal M is disposed in the concave portion 221, it is possible to prevent the alkaline metal M from moving to the center portion side of the window portion 22A by the step of the concave portion 221. In addition, as described above, when viewing from the thickness direction of the window portion 22A, the outer circumferential edge of the concave portion 221 is positioned on the outer side from the wall surface of the through hole 211, and it is possible to keep the alkaline metal M away from the light transmission area of the excitation light.

In the atomic cell 2A which is formed as described above, the concave portion 221 forms a recessed "storage portion" in which the alkaline metal M which is provided in a connection portion of the window portion 22A and the body portion 21 is disposed. It is possible to stably dispose the liquid or solid alkaline metals M in the outer circumferential portion of the window portion 22A by providing the aforementioned storage portion.

In addition, the concave portion 221 extends along the connection portion of the window portion 22A and the body portion 21, and thus it is possible to stably dispose the liquid or solid alkaline metals M in the outer circumferential portion of the window portion 22A regardless of a large amount of the liquid or solid alkaline metals M which are disposed in the inner space S.

Particularly, the concave portion 221 is provided in the window portion 22A, and thus by the step of the concave portion 221 which is formed between the center portion and the outer circumferential portion of the window portion 22A, it is possible to prevent the liquid or solid alkaline metal M which is projected from the concave portion 221 from moving to the center portion of the window portion.

The atomic cell 2A can be manufactured as follows.

Figure 9A:
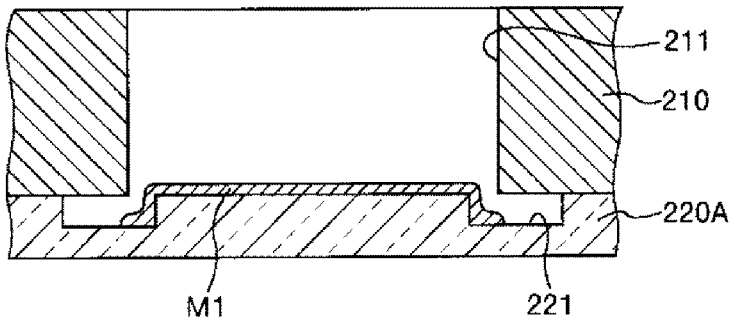
FIGS. 9A to 9C are diagrams illustrating the disposing step, the sealing step, and the adjusting process in the manufacturing method of the atomic cell in FIGS. 8A and 8B.
Figure 9B:
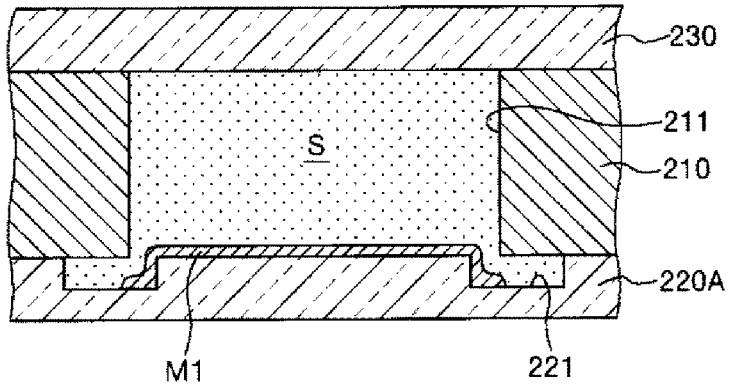
Figure 9C:
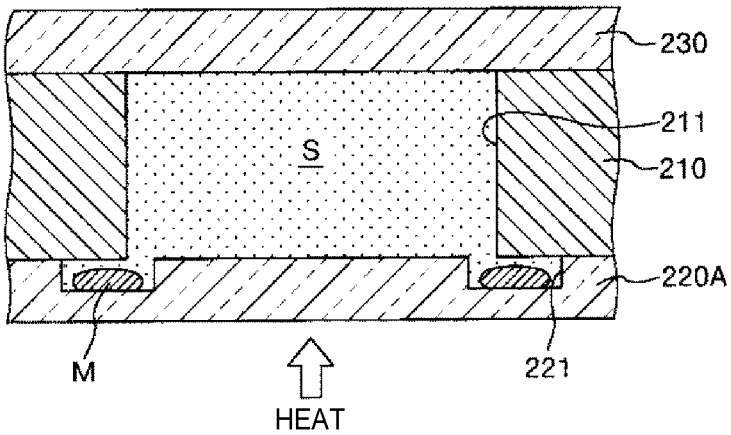

FIGS. 9A to 9C are diagrams illustrating the disposing step, the sealing step and the adjusting process in the atomic cell manufacturing method as illustrated in FIGS. 8A and 8B.

The manufacturing method of the atomic cell 2A includes 1A. Preparing process, 2A. Adjusting process, and 3A. Individualizing process. Hereinafter, each process will be described in order.

1A. Preparing Process 1A-1. First Bonding Process (Base Portion Preparing Step) and 1A-2. Disposing Step First, as illustrated in FIG. 9A, similar to the first bonding process (1-1) and the disposing step (1-2) in the first embodiment described above, the alkaline metal M1 is disposed in the concave portion through the through hole 211 after bonding the substrate for forming body portion 210 and a substrate for forming window portion 220A.

The substrate for forming window portion 220A is a glass substrate for forming the aforementioned window portion 22A, and becomes the window portion 22A by being individualized in 3A. Individualizing process described below.

1A-3. Second Bonding Process (Sealing Step)

Next, as illustrated in FIG. 9B, similar to the second bonding process (1-3) in the first embodiment described above, the substrate for forming body portion 210 (one surface side of the first substrate) and the substrate for forming window portion 230 are bonded to each other.

2A. Adjusting Process

Next, as illustrated in FIG. 9C, the distribution of an amount of the alkaline metal M1 is adjusted by heating the substrates for forming window portion 220A. At that time, the center portion of the substrates for forming window portion 220A is intensively heated. With this, it is possible to move the alkaline metal M1 on the center portion of the substrates for forming window portion 220A to the outer circumferential portion side of the substrates for forming window portion 220A. As a result, the alkaline metals M are distributed so as to be intensively disposed on the outer circumferential portion side compared to the center portion of the substrates for forming window portion 220A.

Particularly, in the embodiment, by heating the substrates for forming window portion 220A as described above, it is possible to move the alkaline metal M1 on the center portion of the substrates for forming window portion 220A to the inside of the concave portion 221 of the substrates for forming window portion 220A. For this reason, it is possible to prevent the alkaline metal M1 from returning to the center portion of the substrate for forming window portion 220A.

3A. Individualizing Process

Next, similar to 3. Individualizing process of the first embodiment described above, the stacked structure (the bonded body) which is formed of the substrate for forming body portion 210 and the substrates for forming window portion 220A and 230 is individualized. With this, it is possible to obtain the atomic cell 2A.

According to the manufacturing method of the atomic cell 2A as described above, in 1A. Preparing process, the structure which is formed of the substrate for forming body portion 210 and the substrates for forming window portion 220A and 230 includes the concave portion 221 (a recessed storage portion) which is provided in the outer circumferential portion of the light transmission portion, and in 2A. Adjusting process, the alkaline metal M is stored in the concave portion 221, and thus it is possible to keep the liquid or solid alkaline metals M away from the light transmission area in the obtained atomic cell 2A.

In addition, the concave portion 221 extends along the outer circumferential portion of the light transmission portion, and thus in the obtained atomic cell 2A, it is possible to keep the liquid or solid alkaline metals M away from the light transmission area regardless of a large amount of the liquid or solid alkaline metals M which are disposed in the inner space S.

Third Embodiment

Next, a third embodiment of the invention will be described.

Figure 10A:
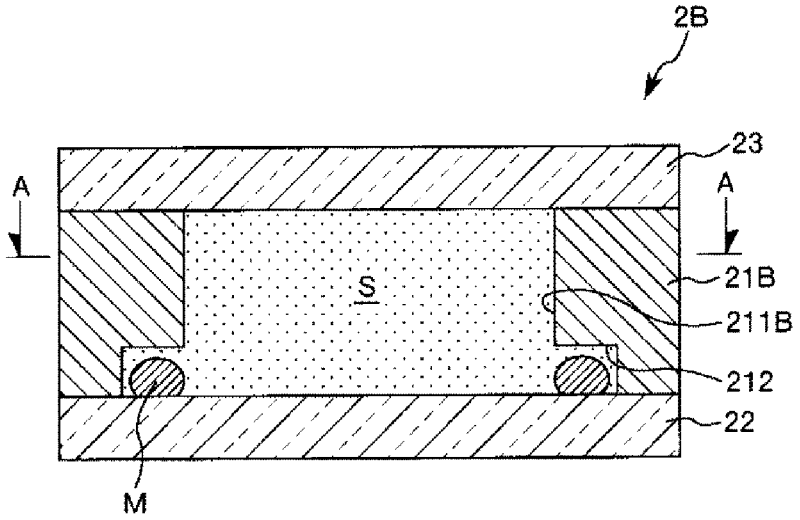
FIG. 10A is a longitudinal sectional view of an atomic cell which is included in an atomic oscillator according to a third embodiment of the invention.
Figure 10B:
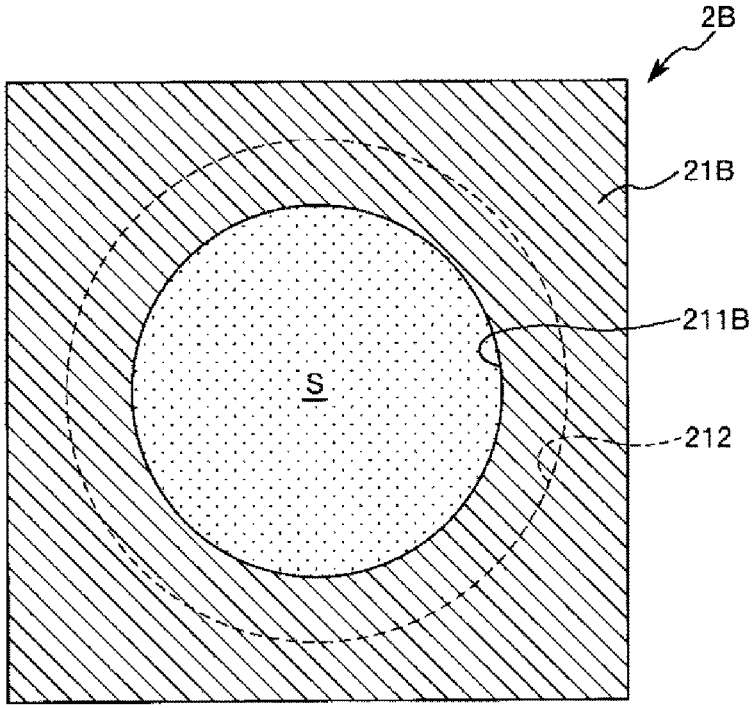
FIG. 10B is a sectional view (cross-sectional view) taken along line A-A in FIG. 10A.

FIG. 10A is a longitudinal sectional view of an atomic cell which is included in an atomic oscillator according to the third embodiment of the invention, and FIG. 10B is a sectional view (cross-sectional view) taken along line A-A in FIG. 10A.

The present embodiment has the same configuration as in the first embodiment except for a configuration of the body portion, and a disposition of the liquid or solid alkaline metal.

Note that, in the following description, the description of the third embodiment will focus on the differences from the embodiments described above and the same matters will be omitted.

As illustrated in FIGS. 10A and 10B, an atomic cell 2B includes a body portion 21B, and a pair of the window portions 22 and 23 which interpose the body portion 21B therebetween.

The body portion 21B is formed into a plate shape of which the vertical direction corresponds to the thickness direction, and the body portion 21B is formed of through holes 211B passing through the thickness direction (the vertical direction) of the body portion 21B. At an end portion on the window portion 22 side of the wall surface of the through hole 211B, throughout a whole range in a circumferential direction, a step portion 212 is formed such that the width of the through hole 211B expands.

The step portion 212 and the window portion 22 form the concave portion. The liquid or solid alkaline metal M is disposed in the concave portion. It is possible to enlarge the light transmission area of the excitation light by disposing the alkaline metal M so as to retreat to the outside.

In the atomic cell 2B which is formed as described above, the concave portion which is formed of the step portion 212 and the window portion 22 forms a recessed "storage portion" in which the alkaline metal M which is provided in a connection portion of the window portion 22 and the body portion 21B is disposed. With such a configuration, it is possible to stably dispose the liquid or solid alkaline metals M in the outer circumferential portion of the window portion 22.

In addition, since the concave portion which is formed of the step portion 212 and the window portion 22 extends along the connection portion of the window portion 22 and the body portion 21B, it is possible to stably dispose the liquid or solid alkaline metals M in the outer circumferential portion of the window portion 22 regardless of a large amount of the liquid or solid alkaline metals M which are disposed in the inner space S.

Particularly, since the step portion 212 is provided in the body portion 21B, it is possible to keep the liquid or solid alkaline metal M away from the light transmission area.

Fourth Embodiment

Next, a fourth embodiment of the invention will be described.

Figure 11A:
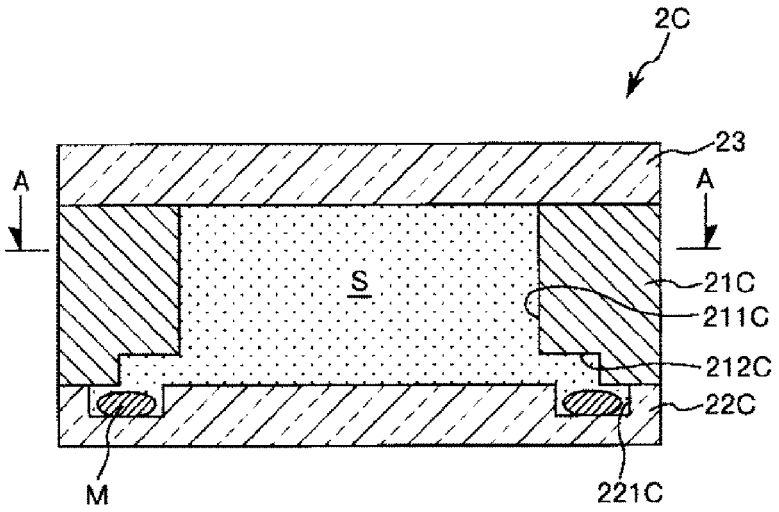
FIG. 11A is a longitudinal sectional view of an atomic cell which is included in an atomic oscillator according to a fourth embodiment of the invention.
Figure 11B:
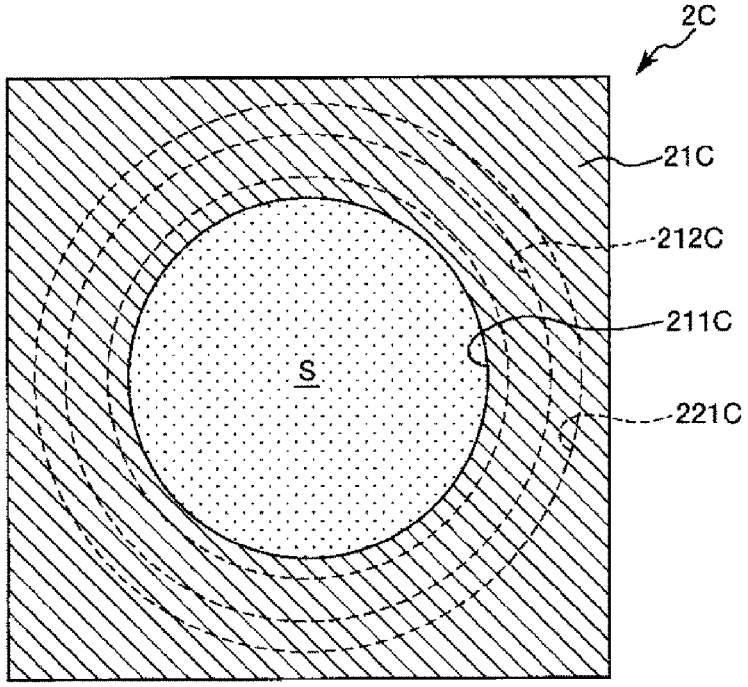
FIG. 11B is a sectional view (cross-sectional view) taken along line A-A in FIG. 11A.

FIG. 11A is a longitudinal sectional view of an atomic cell which is included in an atomic oscillator according to the fourth embodiment of the invention, and FIG. 11B is a sectional view (cross-sectional view) taken along line A-A in FIG. 11A.

The present embodiment has the same configuration as in the first embodiment except for configurations of the body portion and one window portion, and a disposition of the liquid or solid alkaline metal.

Note that, in the following description, the description of the fourth embodiment will focus on the differences from the embodiments described above and the same matters will be omitted.

As illustrated in FIGS. 11A and 11B, an atomic cell 2C includes a body portion 21C, and a pair of window portions 22C and 23 which interpose the body portion 21C therebetween.

The body portion 21C is formed into a plate shape of which the vertical direction corresponds to the thickness direction, and the body portion 21C is formed of through holes 211C passing through the thickness direction (the vertical direction) of the body portion 21C. At an end portion on the window portion 22C side of the wall surface of the through hole 211C, throughout a whole range in a circumferential direction, a step portion 212C is formed such that the width of the through hole 211C expands.

In addition, an annular concave portion 221C (the groove) is formed on the surface on the body portion 21C side of the window portion 22C along the wall surface of the through hole 211C in the body portion 21C. When viewing from the thickness direction of the window portion 22C, as illustrated in FIGS. 11A and 11B, an inner circumferential edge and an outer circumferential edge of the concave portion 221C are respectively positioned on the outer side from the wall surface of the through hole 211C.

The concave portion 221C and the step portion 212C form the concave portion. The liquid or solid alkaline metal M is disposed in the concave portion. It is possible to enlarge the light transmission area of the excitation light by disposing the alkaline metal M so as to retreat to the outside.

Particularly, in the embodiment, the alkaline metal M is disposed in the concave portion 221C. With this, it is possible to prevent the alkaline metal M from moving to the center portion side of the window portion 22C by the step of the concave portion 221C. In addition, as described above, when viewing from the thickness direction of the window portion 22C, the inner circumferential edge and the outer circumferential edge of the concave portion 221C are respectively positioned on the outer side from the wall surface of the through hole 211, and thus it is possible to enlarge the light transmission area of the excitation light by disposing the alkaline metal M in the concave portion 221C.

In the atomic cell 2C which is formed as described above, the concave portion which is formed of the step portion 212C and the concave portion 221C forms a recessed "storage portion" in which the alkaline metal M which is provided in a connection portion of the window portion 22C and the body portion 21C is disposed. With such a configuration, it is possible to stably dispose the liquid or solid alkaline metals M in the outer circumferential portion of the window portion 22C.

Fifth Embodiment

Next, a fifth embodiment of the invention will be described.

Figure 12A:
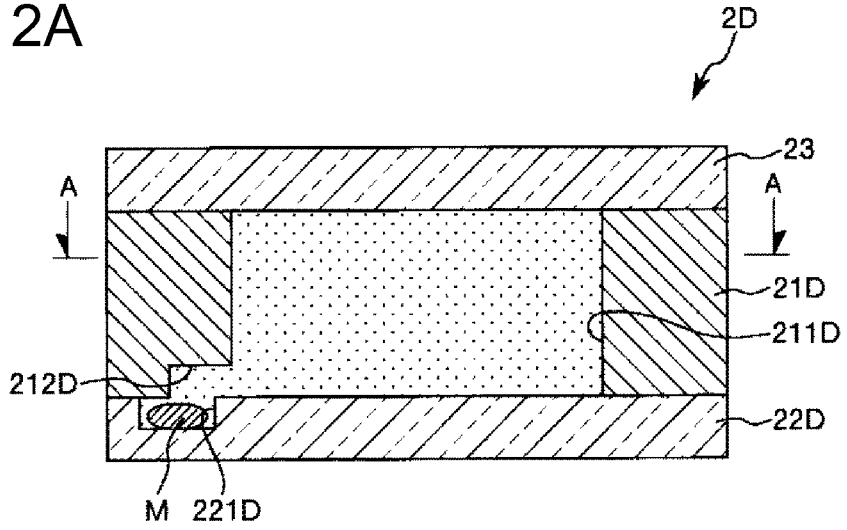
FIG. 12A is a longitudinal sectional view of an atomic cell which is included in an atomic oscillator according to a fifth embodiment of the invention.
Figure 12B:
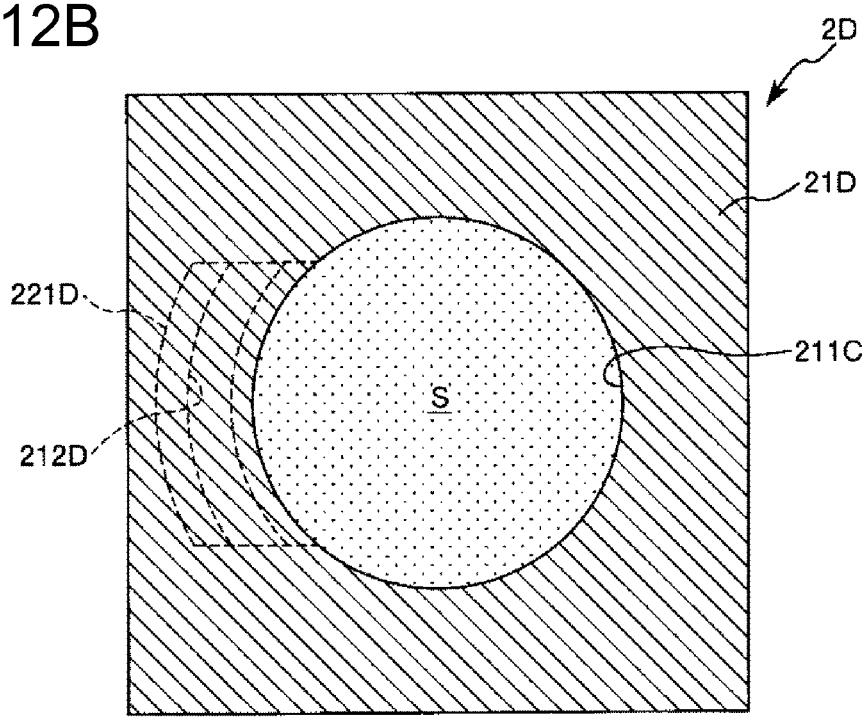
FIG. 12B is a sectional view (cross-sectional view) taken along line A-A in FIG. 12A.

FIG. 12A is a longitudinal sectional view of an atomic cell which is included in an atomic oscillator according to the fifth embodiment of the invention, and FIG. 12B is a sectional view (cross-sectional view) taken along line A-A in FIG. 12A.

The present embodiment has the same configuration as in the first embodiment except for configurations of the body portion and one window portion, and a disposition of the liquid or solid alkaline metal. In addition, the present embodiment has the same configuration as in the fourth embodiment except for a range of forming the step portion of the body portion and the concave portion of the window portion.

Note that, in the following description, the description of the fifth embodiment will focus on the differences from the embodiments described above and the same matters will be omitted.

As illustrated in FIGS. 12A and 12B, an atomic cell 2D includes a body portion 21D, and a pair of window portions 22D and 23 which interpose the body portion 21D therebetween.

The body portion 21D is formed into a plate shape of which a vertical direction corresponds to a thickness direction, and the body portion 21D is formed of through holes 211D passing through the thickness direction (the vertical direction) of the body portion 21D. At an end portion on the window portion 22D side of the wall surface of the through hole 211D, a step portion 212D is provided in a portion in the circumferential direction such that the width of the through hole 211D expands.

In addition, a concave portion 221D (groove) is formed corresponding to the step portion 212D on the surface of the body portion 21D side of the window portion 22D.

The concave portion 221D and the step portion 212D described above form the concave portion. The liquid or solid alkaline metal M is disposed in the concave portion. In this way, when the concave portion for disposing the alkaline metal M is provided in a portion of the through hole 211D in the circumferential direction, it is possible to improve the reliability by realizing the miniaturization of the atomic cell 2D or by enlarging an area obtained by bonding the body portion 21D and the window portion 22D.

Sixth Embodiment

Next, a sixth embodiment of the invention will be described.

Figure 13A:
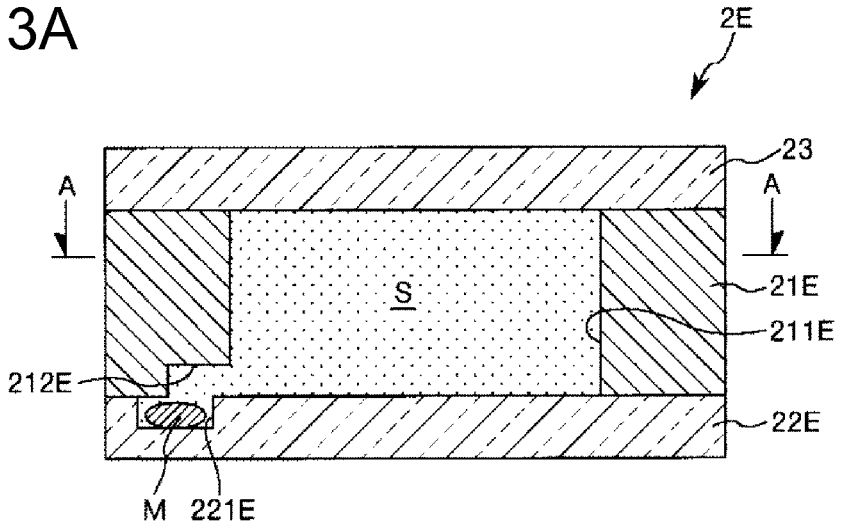
FIG. 13A is a longitudinal sectional view of an atomic cell which is included in an atomic oscillator according to a sixth embodiment of the invention.
Figure 13B:
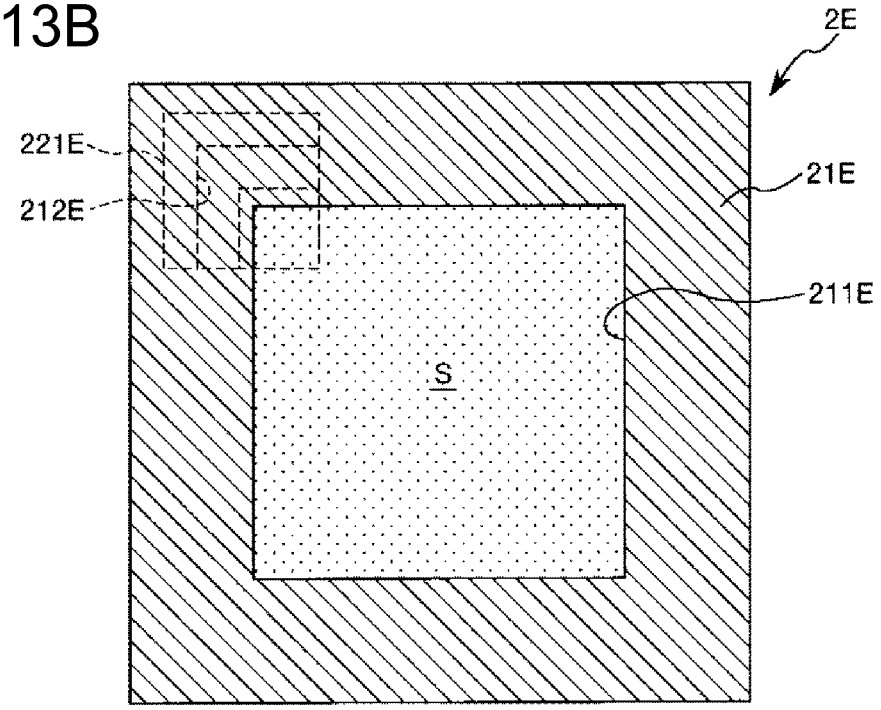
FIG. 13B is a sectional view (cross-sectional view) taken along line A-A in FIG. 13A.

FIG. 13A is a longitudinal sectional view of an atomic cell which is included in an atomic oscillator according to the sixth embodiment, and FIG. 13B is a sectional view (cross-sectional view) taken along line A-A in FIG. 13A.

The present embodiment has the same configuration as in the first embodiment except for configurations of the body portion and one window portion, and a disposition of the liquid or solid alkaline metal. In addition, the present embodiment has the same configuration as in the fifth embodiment except for the cross-sectional shape of the inner space.

Note that, in the following description, the description of the sixth embodiment will focus on the differences from the embodiments described above and the same matters will be omitted.

As illustrated in FIGS. 13A and 13B, an atomic cell 2E includes a body portion 21E, and a pair of window portions 22E and 23 which interpose the body portion 21E therebetween.

The body portion 21E is formed into a plate shape of which the vertical direction corresponds to the thickness direction, and the body portion 21E is formed of through holes 211E passing through the thickness direction (the vertical direction) of the body portion 21E. The cross-sectional shape of the through hole 211E is formed into a quadrangle shape. In addition, at an end portion on the window portion 22E side of the wall surface of the through hole 211E, a step portion 212E is provided at a position corresponding to one corner which is formed into the quadrangle shape such that the width of the through hole 211E expands.

In addition, a concave portion 221E (groove) is formed corresponding to the step portion 212E on the surface of the body portion 21E side of the window portion 22E.

The concave portion 221E and the step portion 212E described above form the concave portion. The liquid or solid alkaline metal M is disposed in the concave portion. In this way, when the concave portion for disposing the alkaline metal M is provided in a portion of the through hole 211E in the circumferential direction, it is possible to improve the reliability by realizing the miniaturization of the atomic cell 2E or by enlarging an area obtained by bonding the body portion 21E and the window portion 22E. Particularly, in the embodiment, the alkaline metal M is disposed corresponding to the corner of the through hole 211E of which the cross-sectional shape is formed into a quadrangle shape, and it is possible to suppress the adverse influence on the gaseous alkaline metal in an area through which the excitation light transmits.

At the time of manufacturing the atomic cell 2E which is formed as described above, in the adjusting process, the alkaline metals M are adjusted so as to be disposed at the corner on the bottom portion of the concave portion through the through hole 211E. With such a configuration, in the obtained atomic cell 2E, it is possible to keep the liquid or solid alkaline metals M away from the light transmission area.

Seventh Embodiment

Next, a seventh embodiment of the invention will be described.

Figure 14A:
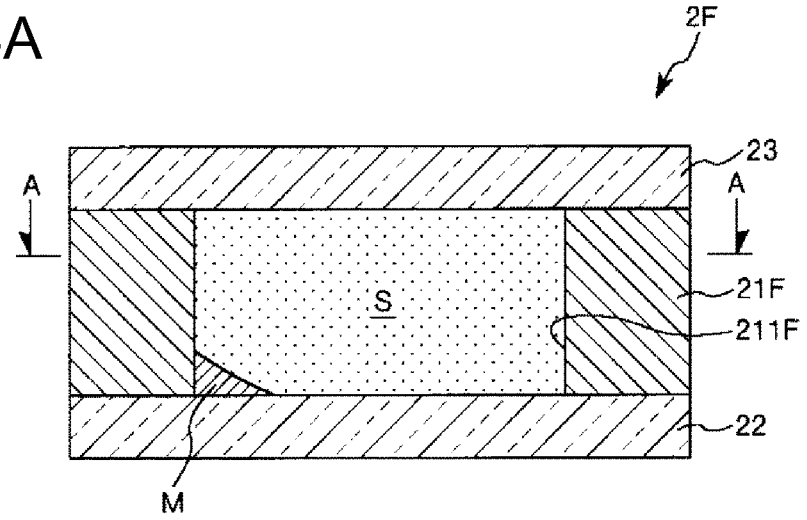
FIG. 14A is a longitudinal sectional view of an atomic cell which is included in an atomic oscillator according to a seventh embodiment of the invention.
Figure 14B:
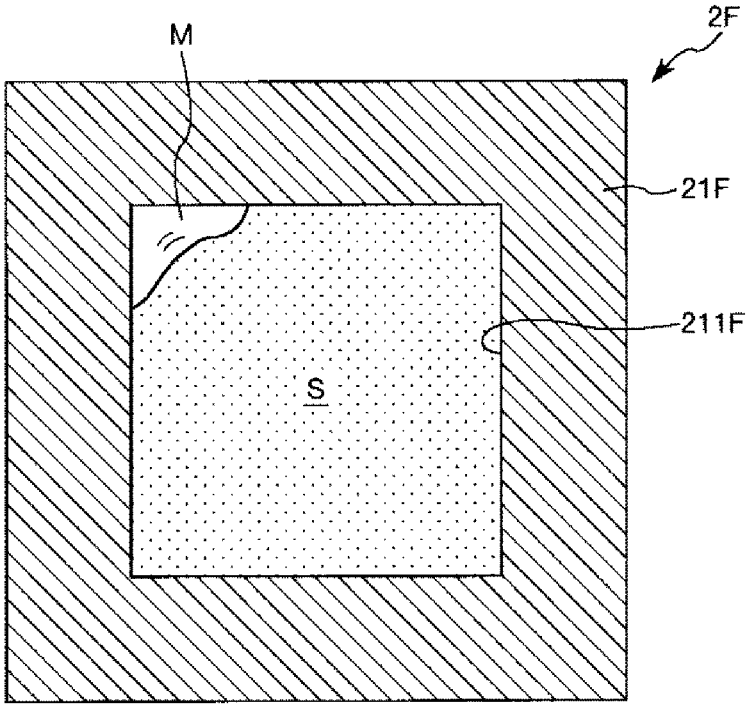
FIG. 14B is a sectional view (cross-sectional view) taken along line A-A in FIG. 14A.

FIG. 14A is a longitudinal sectional view of an atomic cell which is included in an atomic oscillator according to the seventh embodiment of the invention, and FIG. 14B is a sectional view (cross-sectional view) taken along line A-A in FIG. 14A.

The present embodiment has the same configuration as in the first embodiment except for the shape of the inner space and a disposition of the liquid or solid alkaline metal.

Note that, in the following description, the description of the seventh embodiment will focus on the differences from the embodiments described above and the same matters will be omitted.

As illustrated in FIGS. 14A and 14B, an atomic cell 2F includes a body portion 21F, and a pair of the window portions 22 and 23 which interpose the body portion 21F therebetween.

The body portion 21F is formed into a plate shape of which a vertical direction corresponds to a thickness direction, and the body portion 21F is formed of through holes 211F passing through the thickness direction (the vertical direction) of the body portion 21F. The cross-sectional shape of the through hole 211F is the quadrangle shape.

The liquid or solid alkaline metal M is stored in the inner space S which is formed by blocking the through hole 211F with the pair of window portions 22 and 23. The alkaline metal M is formed on the outer circumferential portion of the window portion 22 corresponding to the corner of the through hole 211F. With this, it is possible to suppress the adverse influence on the gaseous alkaline metal in an area through which the excitation light transmits.

2. Electronic Device

The above-described atomic oscillator may be applied to various electronic devices.

Hereinafter, an electronic device according to the invention will be described.

Figure 15:
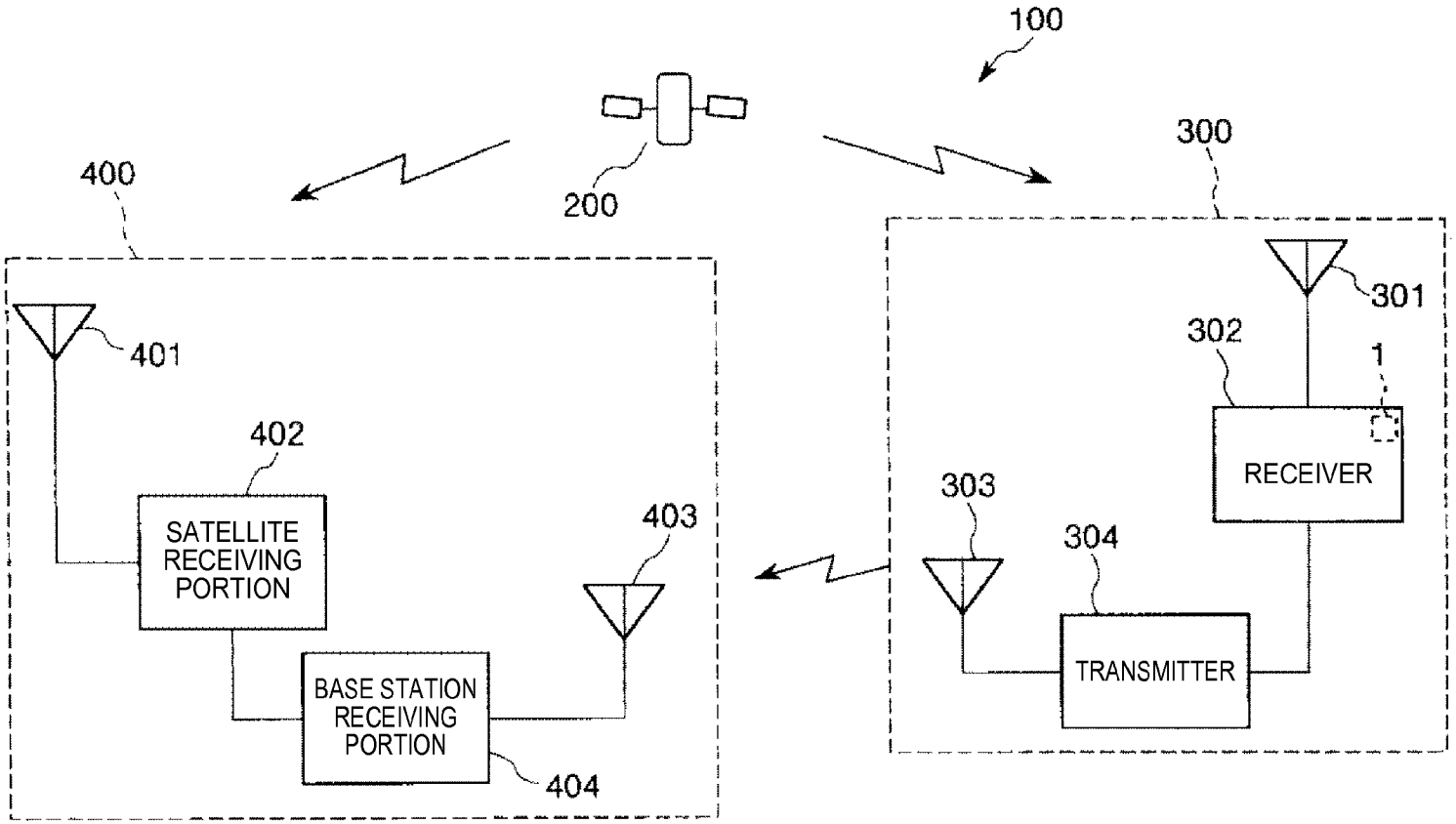
FIG. 15 is a diagram illustrating a schematic configuration when an atomic oscillator according to the invention is used in a positioning system using a GPS satellite.

FIG. 15 is a diagram illustrating a schematic configuration in which the atomic oscillator according to the invention is used in a positioning system using a GPS satellite.

A positioning system 100 as illustrated in FIG. 15 includes a GPS satellite 200, a base station 300, and a GPS receiver 400.

The GPS satellite 200 transmits positioning information (a GPS signal).

The base station 300 includes a receiver 302 that receives positioning information from the GPS satellite 200 through an antenna 301, for example, provided at an electronic reference point (a GPS continuous observation station) with high accuracy, and a transmitter 304 that transmits the positioning information received by the receiver 302 through an antenna 303.

Here, the receiver 302 is an electronic device that includes the atomic oscillator 1 according to the invention as a reference frequency oscillation source. The receiver 302 having such a configuration has excellent reliability. Further, the positioning information received by the receiver 302 is transmitted by the transmitter 304 in real time.

The GPS receiver 400 includes a satellite receiving portion 402 that receives positioning information from the GPS satellite 200 through an antenna 401, and a base station receiving portion 404 that receives positioning information from the base station 300 through an antenna 403.

3. Moving Object

Figure 16:
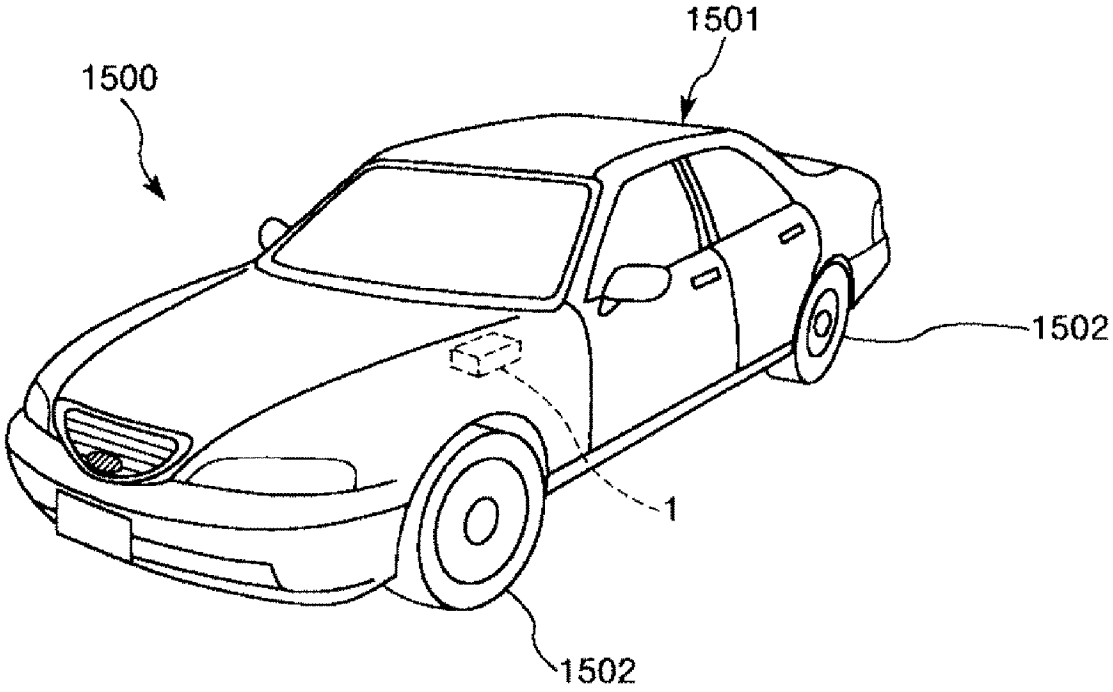
FIG. 16 is a diagram illustrating an example of a moving object according to the invention.

FIG. 16 is a diagram illustrating an example of a moving object according to the invention.

In FIG. 16, a moving object 1500 includes a vehicle body 1501, and four wheels 1502, in which the wheels 1502 are rotated by a power source (engine) (not shown) provided in the vehicle body 1501. The atomic oscillator 1 is built into the moving object 1500.

The electronic device according to the invention is not limited to the above description. For example, the electronic device may be applied to a mobile phone, a digital still camera, an inkjet type discharging apparatus (for example, an inkjet printer), a personal computer (a mobile type personal computer or a laptop type personal computer), a television, a video camera, a video tape recorder, a car navigator, a pager, an electronic organizer (including a communication function), an electronic dictionary, an electronic calculator, an electronic game machine, a word processor, a work station, a video phone, a TV monitor for crime prevention, electronic binoculars, a POS terminal, a medical device (for example, an electronic thermometer, a blood pressure manometer, a blood glucose monitoring system, an electrocardiographic apparatus, ultrasonic diagnostic equipment, or an electronic endoscope), a fish-finder, various measuring apparatuses, meters (for example, meters of a vehicle, an airplane, or a ship), a flight simulator, a terrestrial digital broadcasting system, a mobile phone base station, a GPS module, or the like.

Hereinbefore, embodiments of the atomic cell manufacturing method, the atomic cell, the quantum interference device, the atomic oscillator, the electronic device, and the moving object according to the invention have been described with reference to the accompanying drawings, but the invention is not limited thereto.

In addition, the invention may have a configuration in which an arbitrary component having the same function as in the above-described embodiment is substitutively provided, and a configuration in which an arbitrary component is added thereto.

Further, the invention may have a configuration in which arbitrary components of the above-described embodiments are combined.

Further, in the description of the embodiments above, the atomic cell of the invention is used to the quantum interference device which transitions cesium and the like in a resonant manner by using the coherent population trapping using two types of lights having different wavelengths; however, the atomic cell according to the invention is not limited thereto, but is applicable to a double resonance device which transitions rubidium and the like in a resonant manner by using a double resonance phenomenon due to light and microwaves.

What is claimed is:

1. An atomic cell manufacturing method comprising:

preparing a structure that includes a wall which forms an inner space and a light transmission member, liquid or solid metal atoms being disposed in the light transmission portion; and adjusting distribution of the metal atoms such that the metal atoms are distributed so as to be intensively disposed on an outer circumferential of the light transmission member compared to a center of the light transmission member, wherein the preparing of the structure includes:

preparing a base which is open to one surface side, and includes a concave of which a bottom forms the light transmission member;

disposing the metal atoms at the bottom; and sealing the concave so as to form the inner space.

2. The atomic cell manufacturing method according to claim 1, wherein in the adjusting of the distribution, the distribution is adjusted by heating the light transmission member.

3. The atomic cell manufacturing method according to claim 1, wherein in the disposing of the metal atoms, the metal atoms are deposited and disposed in the bottom.

4. The atomic cell manufacturing method according to claim 1, wherein in the adjusting of the distribution, the metal atoms are adjusted so as to be disposed along the outer circumferential of the bottom.

5. The atomic cell manufacturing method according to claim 1, wherein the bottom includes a corner in a plan view, and wherein in the adjusting of the distribution, the metal atoms are adjusted so as to be disposed at the corner.

6. The atomic cell manufacturing method according to claim 1, wherein in the preparing of the structure, the structure includes a recessed storage member which is provided in the outer circumferential of the light transmission member, and in the adjusting of the distribution, at least part of the metal atoms is disposed in the recessed storage member.

7. The atomic cell manufacturing method according to claim 6, wherein the recessed storage member extends along the outer circumferential of the light transmission member.

8. An atomic cell that is manufactured by the atomic cell manufacturing method according to claim 1.

9. A quantum interference device comprising the atomic cell according to claim 8.

10. An atomic oscillator comprising the atomic cell according to claim 8.

11. An electronic device comprising the atomic cell according to claim 8.

12. A moving object comprising the atomic cell according to claim 8.

13. An atomic cell comprising:

a pair of windows, one of the pair of windows having a recess;

a body which is disposed between the pair of windows and forms an inner space together with the pair of windows;

liquid or solid metal atoms that are distributed in the inner space on the one of the pair of windows so as to be intensively disposed on an outer circumferential of the one of the pair of windows compared to a center of the one of the pair of windows; and a storage member that is configured by the recess which is provided in the one of the pair of windows, wherein the liquid or solid metal atoms are stored into the storage member.

14. A quantum interference device comprising the atomic cell according to claim 13.

15. An atomic oscillator comprising the atomic cell according to claim 13.

16. An atomic cell comprising:

first and second windows;

a body which is disposed between the first and second windows in a first direction and forms an inner space together with the first and second windows;

a step that is formed in part of the body so as to expand the inner space in a second direction perpendicular to the first direction, the step being formed from an inner wall of the body along the first window so that a step inner space is located between the body and the first window; and liquid or solid metal atoms that are distributed in the step inner space on the first window so as to be intensively disposed on an outer circumferential of the first window compared to a center of the first window; and wherein the step is formed from an entirety of the inner wall of the body directly adjacent to the first window so that the step completely surrounds the inner space in a plan view.

* * * * *